US008841052B2

(12) United States Patent
Watariguchi et al.

(10) Patent No.: US 8,841,052 B2
(45) Date of Patent: Sep. 23, 2014

(54) ELECTROPHOTOGRAPHIC PHOTOSENSITIVE MEMBER, PROCESS CARTRIDGE AND ELECTROPHOTOGRAPHIC APPARATUS

(71) Applicant: Canon Kabushiki Kaisha, Tokyo (JP)

(72) Inventors: Kaname Watariguchi, Mishima (JP); Takeshi Murakami, Numazu (JP); Masataka Kawahara, Mishima (JP); Masato Tanaka, Tagata-gun (JP); Akira Yoshida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/683,752

(22) Filed: Nov. 21, 2012

(65) Prior Publication Data

US 2013/0137023 A1 May 30, 2013

(30) Foreign Application Priority Data

Nov. 30, 2011 (JP) ..... 2011-262024
Nov. 15, 2012 (JP) ..... 2012-251040

(51) Int. Cl.
*G03G 5/14* (2006.01)

(52) U.S. Cl.
CPC . *G03G 5/14* (2013.01); *G03G 5/142* (2013.01)
USPC ..... 430/60; 430/58.75; 430/58.5; 430/59.4; 430/59.1

(58) Field of Classification Search
CPC ..... G03G 5/142; G03G 5/0614
USPC ..... 430/60, 59.4, 58.75, 58.5, 59.1; 399/159, 111
See application file for complete search history.

(56) References Cited

U.S. PATENT DOCUMENTS

| | | | | |
|---|---|---|---|---|
| 4,908,329 | A | 3/1990 | Kanai et al. | |
| 4,908,330 | A | 3/1990 | Arai et al. | |
| 5,194,353 | A | 3/1993 | Tanaka et al. | |
| 5,246,807 | A | 9/1993 | Kanemaru et al. | |
| 5,389,478 | A | 2/1995 | Yoshida et al. | |
| 5,393,627 | A * | 2/1995 | Nakamura et al. | 430/58.5 |
| 5,407,766 | A * | 4/1995 | Mayo et al. | 430/59.4 |

(Continued)

FOREIGN PATENT DOCUMENTS

| | | |
|---|---|---|
| CN | 1203383 A | 12/1998 |
| EP | 1 291 507 A2 | 3/2003 |

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 245-264.*

(Continued)

*Primary Examiner* — Christopher Rodee
(74) *Attorney, Agent, or Firm* — Fitzpatrick, Cella, Harper and Scinto

(57) ABSTRACT

In order to provide an electrophotographic photosensitive member with which a ghost is suppressed even under a low temperature and low humidity environment, and a process cartridge and an electrophotographic apparatus having the electrophotographic photosensitive member, the electrophotographic photosensitive member has a support, an undercoat layer formed on the support, and a photosensitive layer formed on the undercoat layer and comprising a charge generating material and a hole transporting material, wherein the undercoat layer comprises a particular amine compound.

9 Claims, 2 Drawing Sheets

(56) References Cited

U.S. PATENT DOCUMENTS

| | | | |
|---|---|---|---|
| 5,453,342 | A | 9/1995 | Go et al. |
| 5,464,718 | A | 11/1995 | Kashizaki et al. |
| 5,527,653 | A | 6/1996 | Tanaka |
| 5,561,015 | A | 10/1996 | Yoshida et al. |
| 5,629,116 | A | 5/1997 | Kashizaki et al. |
| 5,666,589 | A | 9/1997 | Yoshinaga et al. |
| 5,759,291 | A | 6/1998 | Ichinose et al. |
| 5,811,212 | A | 9/1998 | Tanaka |
| 5,818,489 | A | 10/1998 | Yoshinaga et al. |
| 5,876,888 | A | 3/1999 | Anayama et al. |
| 5,910,386 | A | 6/1999 | Yoshinaga et al. |
| 5,912,098 | A | 6/1999 | Tanaka et al. |
| 5,958,638 | A | 9/1999 | Katayama et al. |
| 6,040,100 | A | 3/2000 | Tanaka et al. |
| 6,093,515 | A | 7/2000 | Yoshida et al. |
| 6,139,997 | A | 10/2000 | Tanaka et al. |
| 6,146,800 | A | 11/2000 | Yoshida et al. |
| 6,183,922 | B1 | 2/2001 | Takai et al. |
| 6,190,811 | B1 | 2/2001 | Tanaka et al. |
| 6,218,063 | B1 | 4/2001 | Tanaka et al. |
| 6,245,472 | B1 | 6/2001 | Tanaka |
| 6,248,490 | B1 | 6/2001 | Suzuki et al. |
| 6,258,498 | B1 | 7/2001 | Kawahara et al. |
| 6,270,936 | B1 | 8/2001 | Tanaka et al. |
| 6,296,978 | B1 | 10/2001 | Takaya et al. |
| 6,335,132 | B1 | 1/2002 | Tanaka et al. |
| 6,472,524 | B2 | 10/2002 | Tanaka |
| 6,551,752 | B2 | 4/2003 | Takaya et al. |
| 6,623,899 | B2 | 9/2003 | Takaya et al. |
| 6,683,175 | B2 | 1/2004 | Tanaka |
| 6,773,856 | B2 | 8/2004 | Tanaka et al. |
| 6,833,227 | B2 | 12/2004 | Tanaka |
| 6,942,952 | B2 | 9/2005 | Uesugi et al. |
| 6,991,881 | B2 | 1/2006 | Ogaki et al. |
| 7,001,699 | B2 | 2/2006 | Tanaka et al. |
| 7,245,851 | B2 | 7/2007 | Fujii et al. |
| 7,276,318 | B2 | 10/2007 | Fujii et al. |
| 7,333,752 | B2 | 2/2008 | Kawahara et al. |
| 7,517,626 | B2 | 4/2009 | Fujii et al. |
| 7,551,878 | B2 | 6/2009 | Ogaki et al. |
| 7,585,604 | B2 | 9/2009 | Ogaki et al. |
| 7,622,238 | B2 | 11/2009 | Uematsu et al. |
| 7,629,102 | B2 | 12/2009 | Ochi et al. |
| 7,702,256 | B2 | 4/2010 | Nukada et al. |
| 7,718,331 | B2 | 5/2010 | Uematsu et al. |
| 7,749,667 | B2 | 7/2010 | Kawahara et al. |
| 7,910,274 | B2 | 3/2011 | Tanaka et al. |
| 7,927,774 | B2 | 4/2011 | Ogaki et al. |
| 8,088,541 | B2 | 1/2012 | Tanaka et al. |
| 2009/0035674 | A1 | 2/2009 | Wu |
| 2009/0162767 | A1 | 6/2009 | Wu |
| 2011/0045390 | A1 | 2/2011 | Tanaka |
| 2011/0293323 | A1 | 12/2011 | Tanaka et al. |
| 2012/0003576 | A1 | 1/2012 | Tanaka et al. |
| 2012/0033994 | A1 | 2/2012 | Tanaka et al. |

FOREIGN PATENT DOCUMENTS

| | | | |
|---|---|---|---|
| JP | 58-17450 | A | 2/1983 |
| JP | 8-95278 | A | 4/1996 |
| JP | 2002-91044 | A | 3/2002 |
| JP | 2006-30698 | A | 2/2006 |
| JP | 2007-148293 | A | 6/2007 |

OTHER PUBLICATIONS

Borsenberger, Paul M. et al. Organic Photoreceptors for Imaging Systems. New York: Marcel-Dekker, Inc. (1993) pp. 6-9, 289-292.*
European Search Report dated Mar. 15, 2013 in European Application No. 12194617.2.
Tanaka, et al., U.S. Appl. No. 13/688,880, filed Nov. 29, 2012.
Kawahara, et al., U.S. Appl. No. 13/688,846, filed Nov. 29, 2012.
Chinese Office Action dated Jun. 30, 2014 in Chinese Application No. 201210500984.0.

* cited by examiner

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus having the electrophotographic photosensitive member.

2. Description of the Related Art

Recently, an electrophotographic photosensitive member (organic electrophotographic photosensitive member) having a photosensitive layer comprising a charge generating material and a hole transporting material (charge transporting material) which are organic compounds has been widely used in an electrophotographic apparatus such as a copier and a laser beam printer.

Among charge generating materials, a phthalocyanine pigment and an azo pigment are known as a charge generating material having a high sensitivity.

On the other hand, in an electrophotographic photosensitive member using a phthalocyanine pigment or an azo pigment, the amount of photo carriers (holes and electrons) generated is large and thus electrons as counters of holes transferred by a hole transporting material tend to remain in a photosensitive layer (charge generation layer). Therefore, the electrophotographic photosensitive member using a phthalocyanine pigment or an azo pigment has a problem in that a phenomenon called ghost tends to occur. Specifically, a positive ghost having a high density in only a region irradiated with light at the time of pre-rotation and a negative ghost having a low density in only a region irradiated with light at the time of pre-rotation are observed in an output image.

Japanese Patent Application Laid-Open No. 2002-091044 discloses a technique in which an undercoat layer provided between a conductive support and a photosensitive layer comprises an electron transporting organic compound and a polyamide resin, thereby reducing variations in exposure potential and residual potential by an environment.

Japanese Patent Application Laid-Open No. 2007-148293 discloses a technique in which a charge generation layer and an intermediate later provided between a support and the charge generation layer contain an electron transporting material, thereby suppressing a ghost.

Japanese Patent Application Laid-Open No. H08-095278 discloses a technique in which a photosensitive layer comprises a benzophenone derivative, thereby enhancing gas resistance and suppressing deterioration in sensitivity and reduction in chargeability.

Japanese Patent Application Laid-Open No. 558-017450 discloses a technique in which a layer comprising a benzophenone derivative is provided between a support and a photosensitive layer, thereby suppressing deterioration in sensitivity after repeated use.

Currently, it is desired to suppress a ghost under various environments. Although a ghost particularly tends to occur under a low temperature and low humidity environment among various environments, the above techniques are not sufficient in terms of the effect of suppressing a ghost under a low temperature and low humidity environment.

An object of the present invention is to provide an electrophotographic photosensitive member with which a ghost is suppressed even under a low temperature and low humidity environment, and a process cartridge and an electrophotographic apparatus having the electrophotographic photosensitive member.

SUMMARY OF THE INVENTION

The present invention provides an electrophotographic photosensitive member having a support, an undercoat layer formed on the support, and a photosensitive layer formed on the undercoat layer and comprising a charge generating material and a hole transporting material, wherein the undercoat layer comprises an amine compound represented by the following formula (1):

(1)

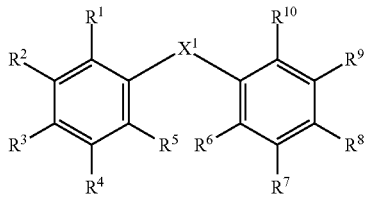

where, in the formula (1), $R^1$ to $R^{10}$ each independently represent a hydrogen atom, a halogen atom, a hydroxy group, a carboxyl group, an alkoxycarbonyl group, an aryloxycarbonyl group, a substituted or unsubstituted acyl group, a substituted or unsubstituted alkyl group, a substituted or unsubstituted alkoxy group, a substituted or unsubstituted aryloxy group, a substituted or unsubstituted amino group, or a substituted or unsubstituted cyclic amino group, provided that at least one of $R^1$ to $R^{10}$ represents an amino group substituted with a substituted or unsubstituted aryl group, an amino group substituted with a substituted or unsubstituted alkyl group, or a substituted or unsubstituted cyclic amino group; and $X^1$ represents a carbonyl group or a dicarbonyl group.

The present invention also provides a process cartridge that integrally supports the electrophotographic photosensitive member and at least one unit selected from the group consisting of a charging unit, a developing unit, a transfer unit and a cleaning unit, and that is detachably mountable to a main body of an electrophotographic apparatus.

The present invention also provides an electrophotographic apparatus having the electrophotographic photosensitive member, and a charging unit, an image exposure unit, a developing unit and a transfer unit.

The present invention can provide an electrophotographic photosensitive member with which a ghost is suppressed even under a low temperature and low humidity environment, and a process cartridge and an electrophotographic apparatus having the electrophotographic photosensitive member.

Further features of the present invention will become apparent from the following description of exemplary embodiments with reference to the attached drawings.

DESCRIPTION OF THE EMBODIMENTS

Figure 1:
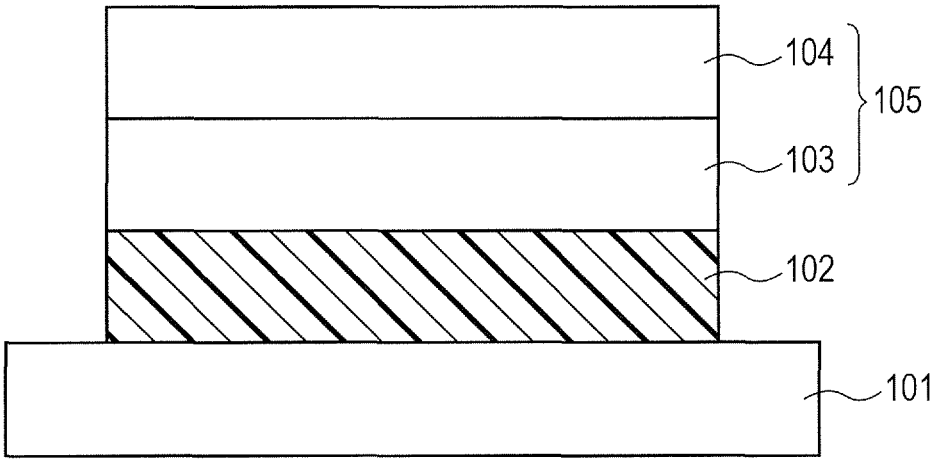
FIG. 1 is a view illustrating one example of a layer structure of an electrophotographic photosensitive member.

Preferred embodiments of the present invention will now be described in detail in accordance with the accompanying drawings.

The electrophotographic photosensitive member of the present invention is an electrophotographic photosensitive member having a support, an undercoat layer (also referred as to intermediate layer or barrier layer) formed on the support, and a photosensitive layer formed on the undercoat layer and comprising a charge generating material and a hole transporting material. In the present invention, the undercoat layer comprises an amine compound represented by the following formula (1).

(1)

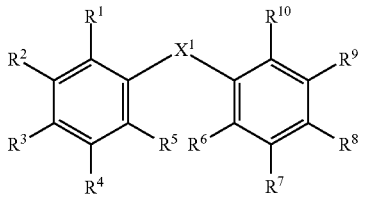

In the formula (1), $R^1$ to $R^{10}$ each independently represent a hydrogen atom, a halogen atom, a hydroxy group, a carboxyl group, an alkoxycarbonyl group, an aryloxycarbonyl group, a substituted or unsubstituted acyl group, a substituted or unsubstituted alkyl group, a substituted or unsubstituted alkoxy group, a substituted or unsubstituted aryloxy group, a substituted or unsubstituted amino group, or a substituted or unsubstituted cyclic amino group, provided that at least one of $R^1$ to $R^{10}$ represents an amino group substituted with a substituted or unsubstituted aryl group, an amino group substituted with a substituted or unsubstituted alkyl group, or a substituted or unsubstituted cyclic amino group; and $X^1$ represents a carbonyl group or a dicarbonyl group.

The amine compound represented by the formula (1) can be an amine compound in which at least one of the $R^1$ to $R^{10}$ in the formula (1) is an amino group substituted with a substituted or unsubstituted alkyl group.

The amino group substituted with a substituted or unsubstituted alkyl group can be an amino group substituted with an alkyl group substituted with an alkoxy group, an amino group substituted with an alkyl group substituted with an aryl group, or an amino group substituted with an unsubstituted alkyl group.

The amino group substituted with a substituted or unsubstituted alkyl group can be a dialkyl amino group, and the dialkyl amino group can be a dimethylamino group or a diethylamino group.

The amine compound represented by the formula (1) can be an amine compound in which at least one of the $R^1$ to $R^{10}$ in the formula (1) is a substituted or unsubstituted cyclic amino group.

The substituted or unsubstituted cyclic amino group can be a morpholino group or a 1-piperidyl group.

The amine compound represented by the formula (1) can be particularly an amine compound represented by any of the following formulas (2) to (4) from the viewpoint of suppressing a ghost.

(2)

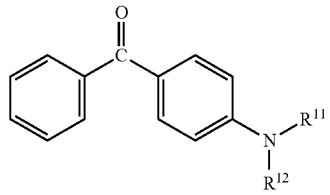

(3)

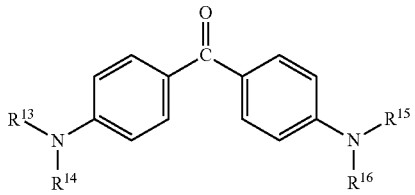

(4)

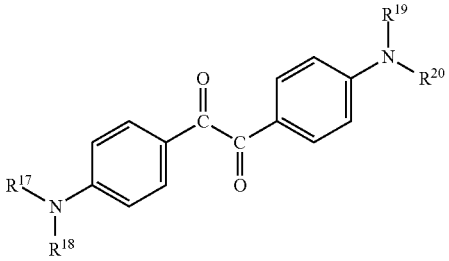

In the formulas (2) to (4), $R^{11}$, $R^{13}$, $R^{15}$, $R^{17}$ and $R^{19}$ each independently represent a hydrogen atom, a substituted or unsubstituted alkyl group, or a substituted or unsubstituted aryl group. $R^{12}$, $R^{14}$, $R^{16}$, $R^{18}$ and $R^{20}$ each independently represent a substituted or unsubstituted alkyl group, or a substituted or unsubstituted aryl group. Alternatively, $R^{11}$ and $R^{12}$ may be bound to each other to form a substituted or unsubstituted cyclic amino group, $R^{13}$ and $R^{14}$ may be bound to each other to form a substituted or unsubstituted cyclic amino group, $R^{15}$ and $R^{16}$ may be bound to each other to form a substituted or unsubstituted cyclic amino group, $R^{17}$ and $R^{18}$ may be bound to each other to form a substituted or unsubstituted cyclic amino group, and $R^{19}$ and $R^{20}$ may be bound to each other to form a substituted or unsubstituted cyclic amino group.

The amine compound represented by any of the formulas (2) to (4) can be an amine compound in which the $R^{11}$ to $R^{20}$ in any of the formulas (2) to (4) are each an alkyl group substituted with an alkoxy group, an alkyl group substituted with an aryl group or an unsubstituted alkyl group.

The unsubstituted alkyl group can be a methyl group or an ethyl group.

The amine compound represented by any of the formulas (2) to (4) can be an amine compound in which the $R^{11}$ and $R^{12}$, the $R^{13}$ and $R^{14}$, the $R^{15}$ and $R^{16}$, the $R^{17}$ and $R^{18}$, and the $R^{19}$ and $R^{20}$ in any of the formulas (2) to (4) are bound to each other to form a substituted or unsubstituted cyclic amino group.

The substituted or unsubstituted cyclic amino group can be a morpholino group or a 1-piperidyl group.

Examples of a substituent that may be comprised in each group of the substituted or unsubstituted acyl group, the substituted or unsubstituted alkyl group, the substituted or unsubstituted alkoxy group, the substituted or unsubstituted aryloxy group, the substituted or unsubstituted amino group, the substituted or unsubstituted aryl group and the substituted or unsubstituted cyclic amino group in each of the formulas (1) to (4) include an alkyl group such as a methyl group, an ethyl group, a propyl group and a butyl group, an alkoxy group such as a methoxy group and an ethoxy group, a dialkyl amino group such as a dimethylamino group and a diethylamino group, an alkoxycarbonyl group such as a methoxycarbonyl group and an ethoxycarbonyl group, an aryl group such as a phenyl group, a naphthyl group and a biphenylyl group, a halogen atom such as a fluorine atom, a chlorine atom and a bromine atom, a hydroxy group, a nitro group, a cyano group and a halomethyl group. Among them, such a substituent can be an aryl group or an alkoxy group.

The present inventors consider as follows the reason why the electrophotographic photosensitive member of the present invention is excellent in the effect of suppressing a ghost.

Namely, the amine compound represented by the formula (1) comprised in the undercoat layer of the electrophotographic photosensitive member of the present invention is an amine compound having a benzophenone skeleton as a basic skeleton and having at least one of an amino group substituted with a substituted or unsubstituted aryl group, an amino group substituted with a substituted or unsubstituted alkyl group, or a substituted or unsubstituted cyclic amino group. In this way, the amine compound represented by the formula (1) has a substituent (substituted or unsubstituted aryl group, or substituted or unsubstituted alkyl group) via an amino group or has an amino group having a cyclic structure to thereby deform the space between electron orbits of a benzophenone skeleton which is a basic skeleton, which is considered to have a favorable effect on charge retention properties. In addition, the benzophenone skeleton as a basic skeleton has a larger dipole moment than, for example, an anthraquinone skeleton, which is also considered to have an advantage for the effect of suppressing a ghost.

Hereinafter, specific exemplary examples of the amine compound represented by the formula (1) (exemplary compounds) will be represented, but the present invention is not limited to the exemplary compounds.

exemplary compound (1)

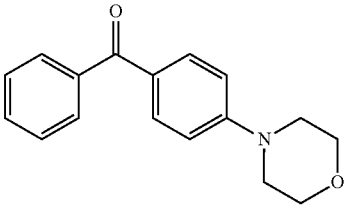

exemplary compound (2)

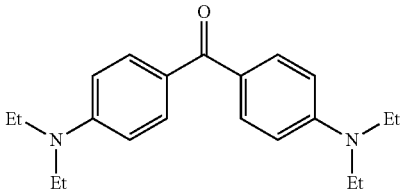

exemplary compound (3)

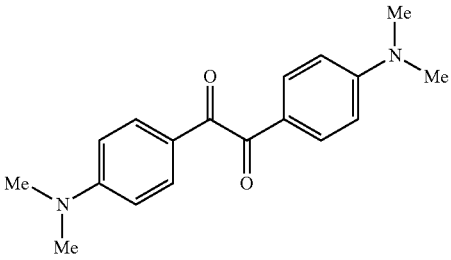

-continued exemplary compound (4)

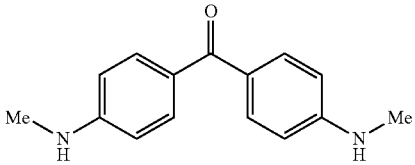

exemplary compound (5)

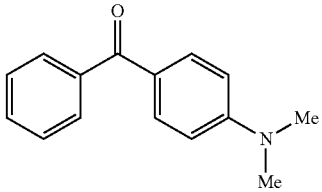

exemplary compound (6)

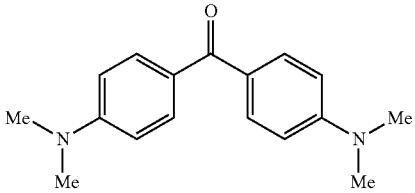

exemplary compound (7)

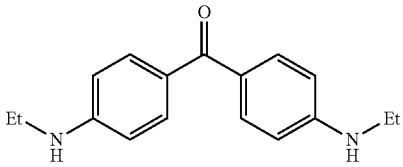

exemplary compound (8)

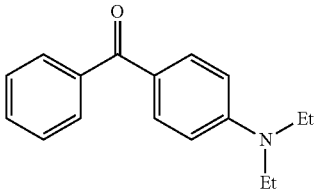

exemplary compound (9)

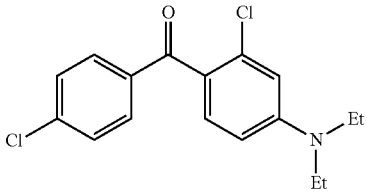

exemplary compound (10)

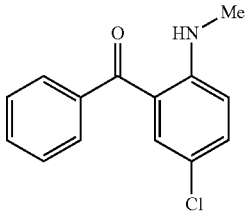

-continued
exemplary compound (11)
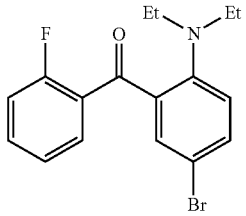
exemplary compound (12)
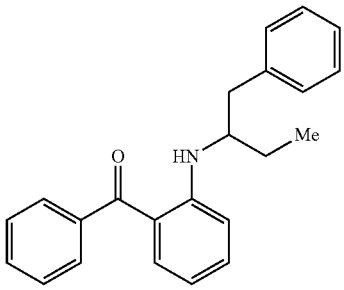
exemplary compound (13)
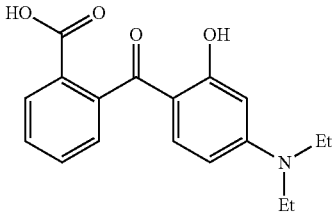
exemplary compound (14)
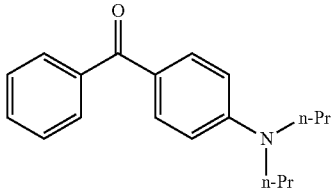
exemplary compound (15)
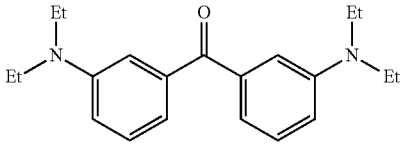
exemplary compound (16)
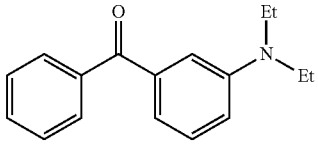
exemplary compound (17)
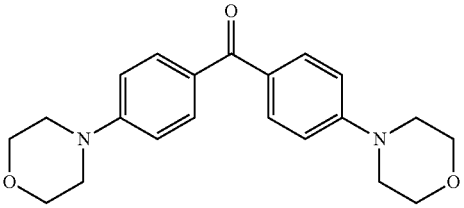
-continued
exemplary compound (18)
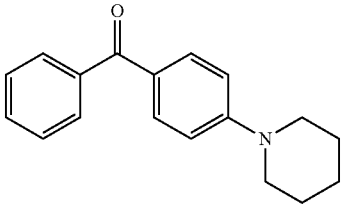
exemplary compound (19)
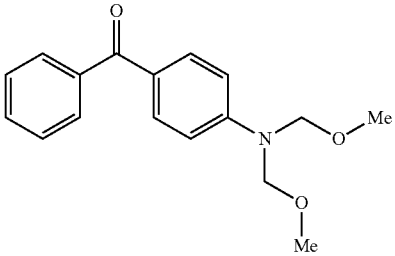
exemplary compound (20)
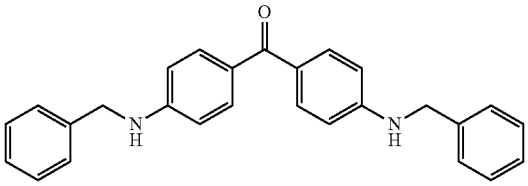
exemplary compound (21)
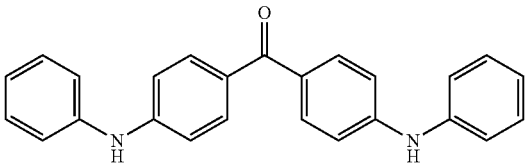
exemplary compound (22)
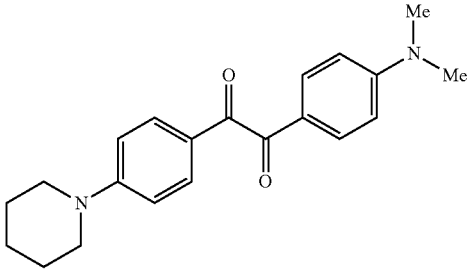
exemplary compound (23)
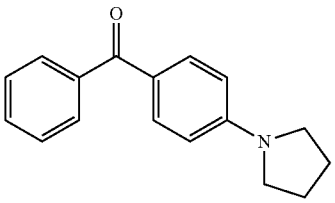

-continued
exemplary compound (24)
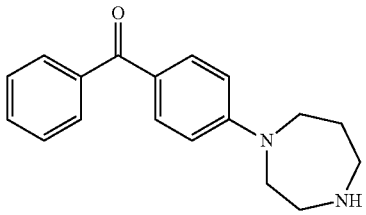
exemplary compound (25)
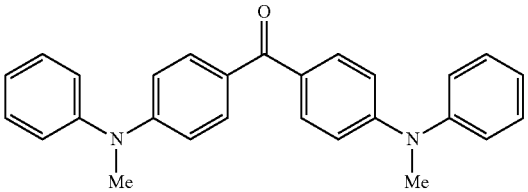
exemplary compound (26)
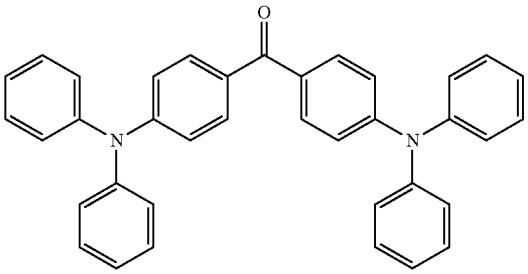
exemplary compound (27)
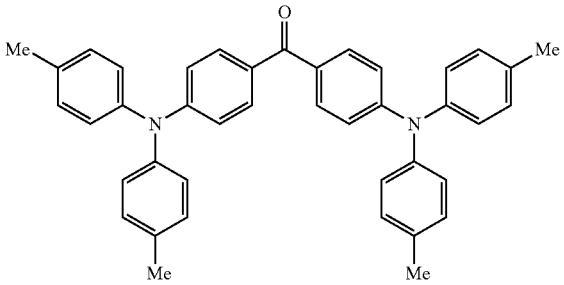
exemplary compound (28)
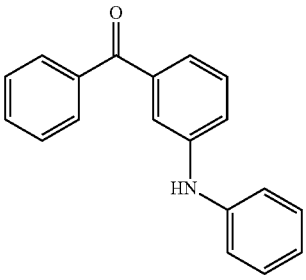
exemplary compound (29)
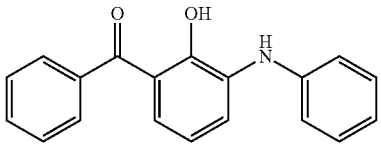
-continued
exemplary compound (30)
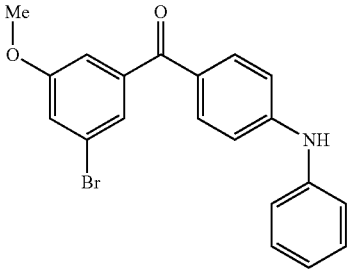
exemplary compound (31)
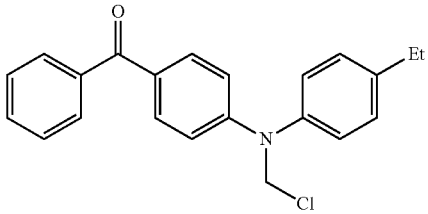
exemplary compound (32)
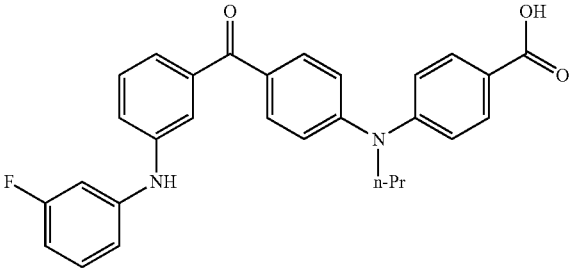
exemplary compound (33)
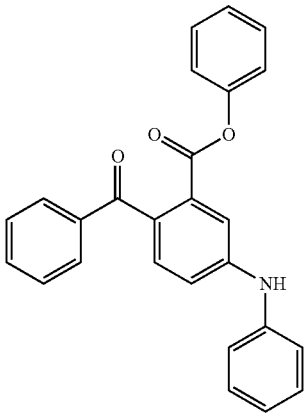
exemplary compound (34)
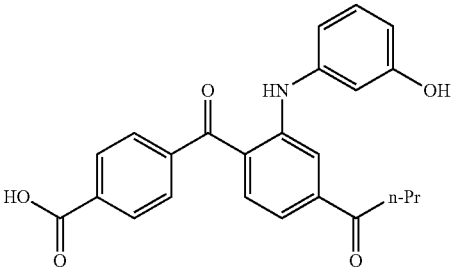

-continued
exemplary compound (35)
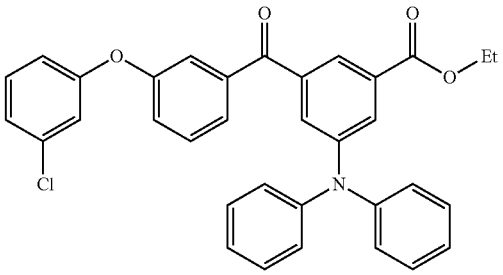
exemplary compound (36)
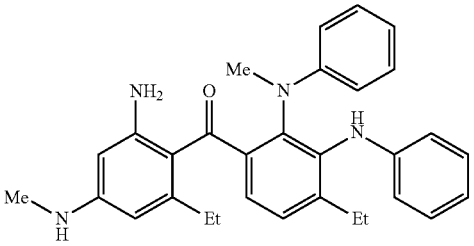
exemplary compound (37)
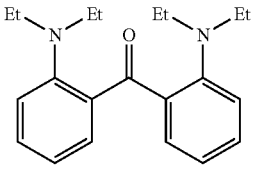
exemplary compound (38)
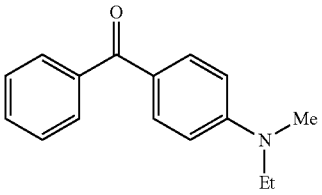
exemplary compound (39)
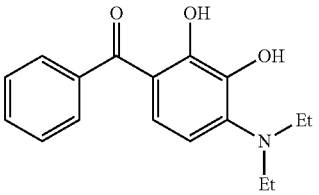
exemplary compound (40)
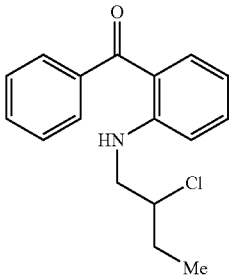
-continued
exemplary compound (41)
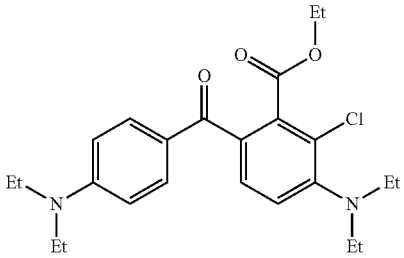
exemplary compound (42)
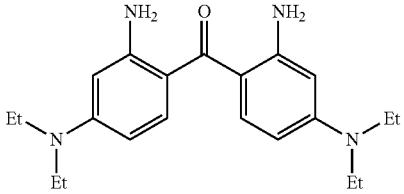
exemplary compound (43)
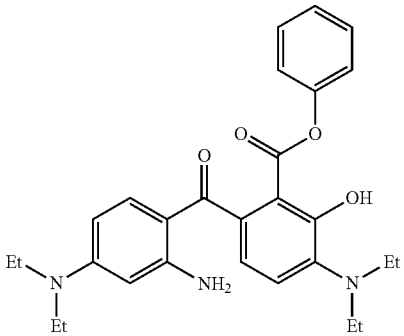
exemplary compound (44)
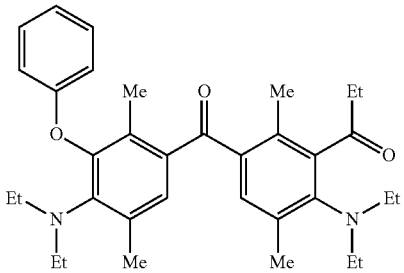
exemplary compound (45)
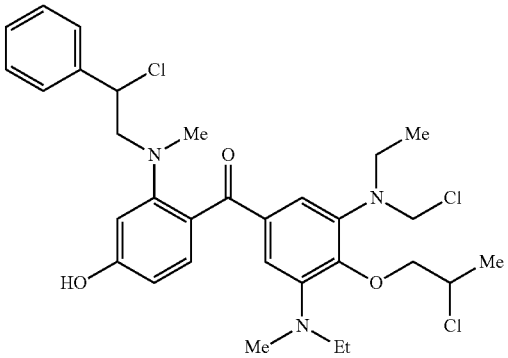

-continued
exemplary compound (46)
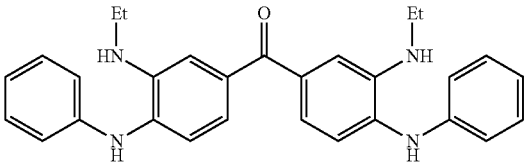
exemplary compound (47)
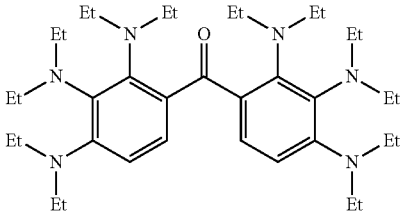
exemplary compound (48)
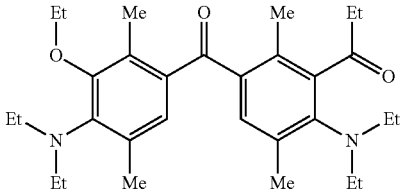
exemplary compound (49)
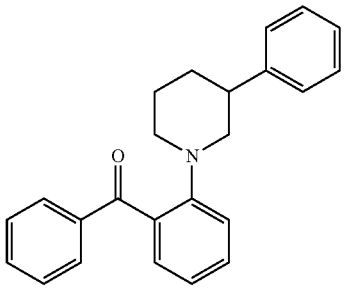
exemplary compound (50)
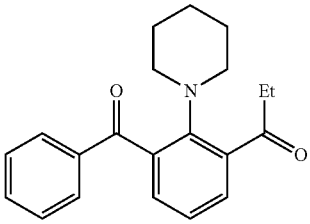
exemplary compound (51)
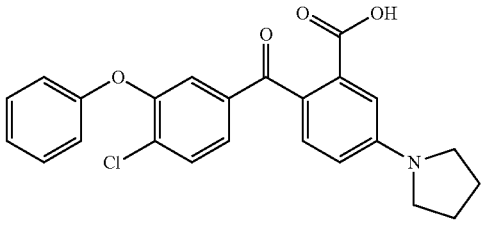
-continued
exemplary compound (52)
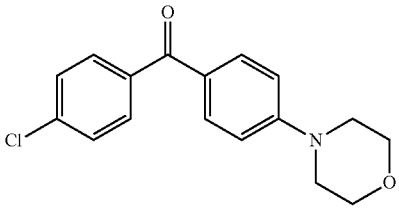
exemplary compound (53)
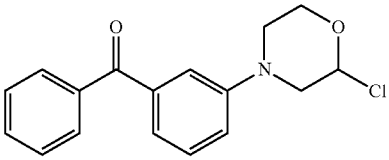
exemplary compound (54)
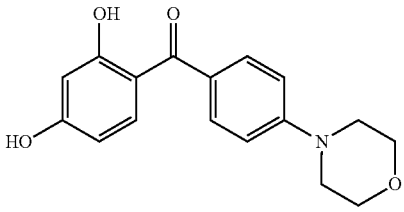
exemplary compound (55)
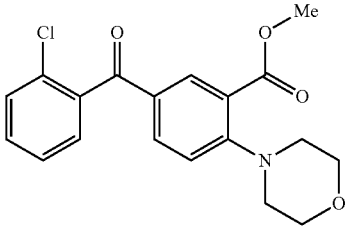
exemplary compound (56)
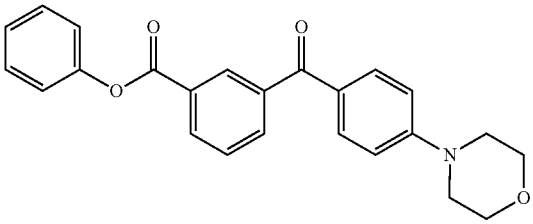
exemplary compound (57)
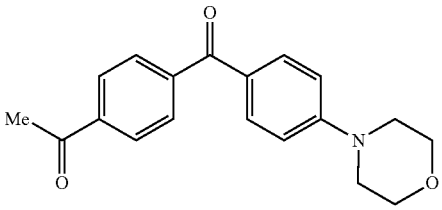
exemplary compound (58)
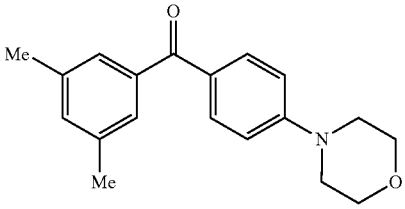

-continued
exemplary compound (59)
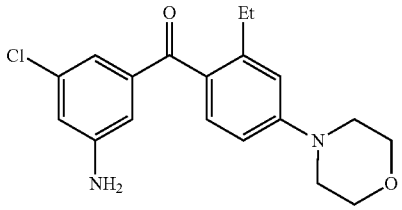
exemplary compound (60)
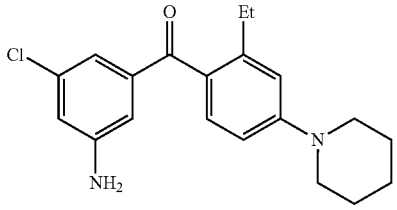
exemplary compound (61)
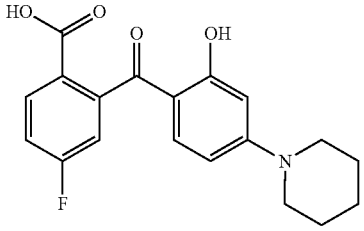
exemplary compound (62)
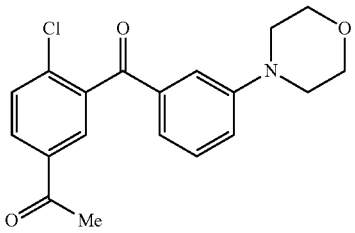
exemplary compound (63)
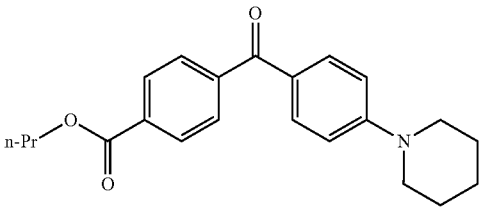
exemplary compound (64)
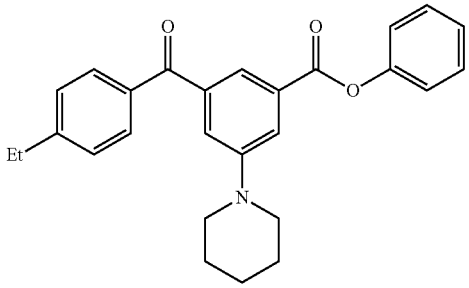
-continued
exemplary compound (65)
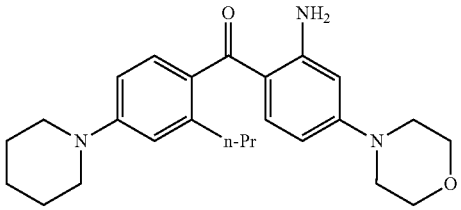
exemplary compound (66)
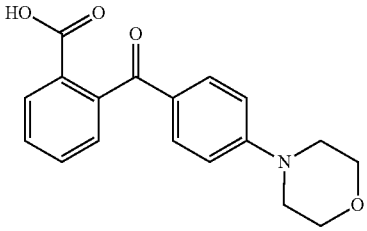
exemplary compound (67)
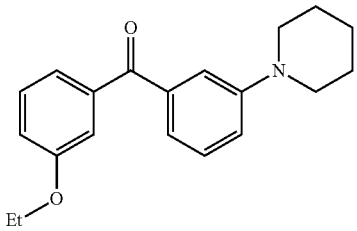
exemplary compound (68)
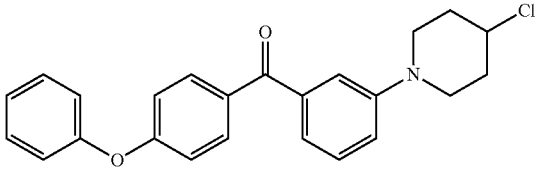
exemplary compound (69)
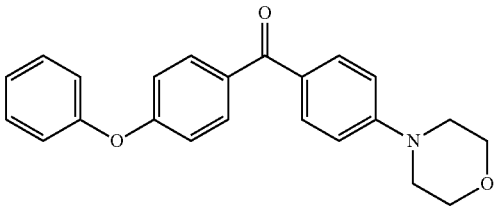
exemplary compound (70)
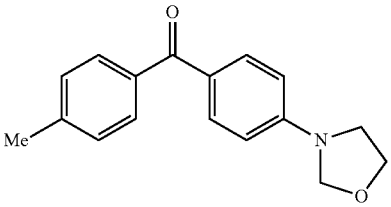

-continued
exemplary compound (71)
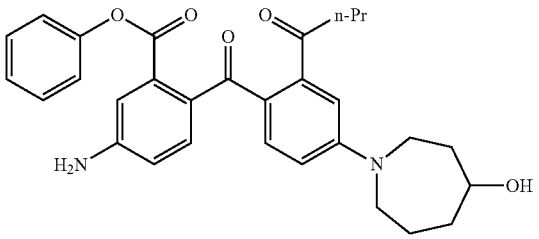
exemplary compound (72)
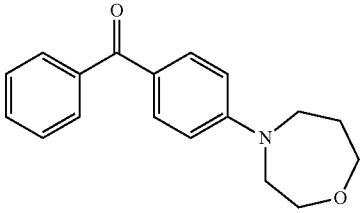
exemplary compound (73)
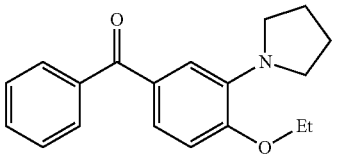
exemplary compound (74)
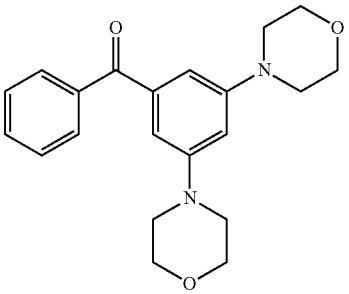
exemplary compound (75)
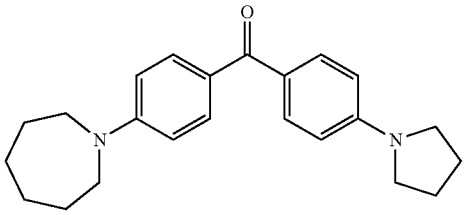
exemplary compound (76)
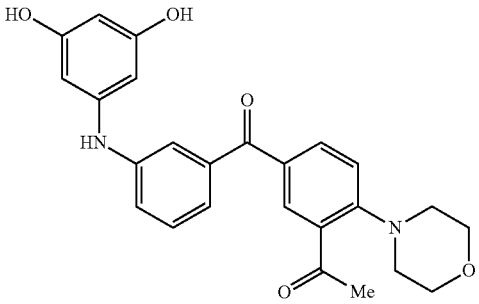
-continued
exemplary compound (77)
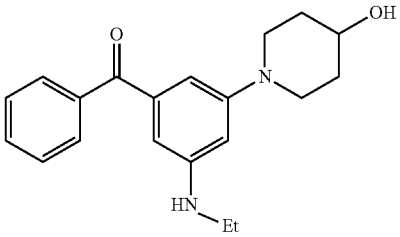
exemplary compound (78)
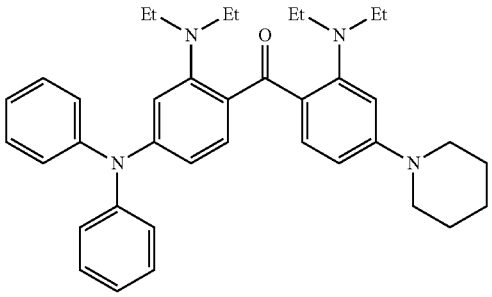
exemplary compound (79)
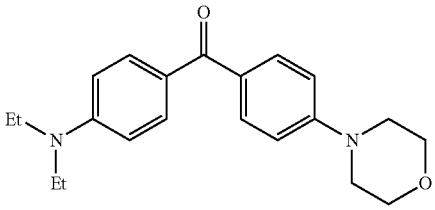
exemplary compound (80)
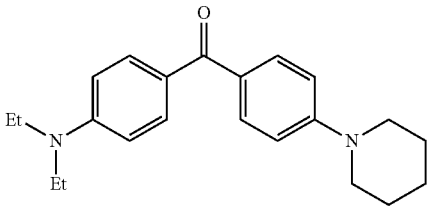
exemplary compound (81)
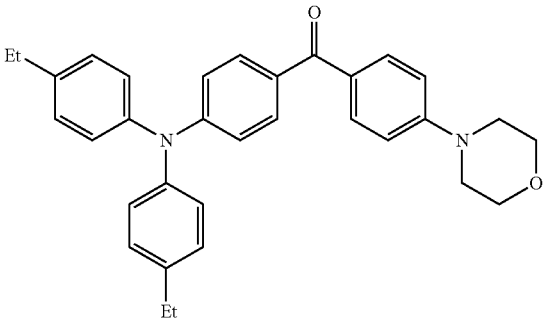

-continued
exemplary compound (82)
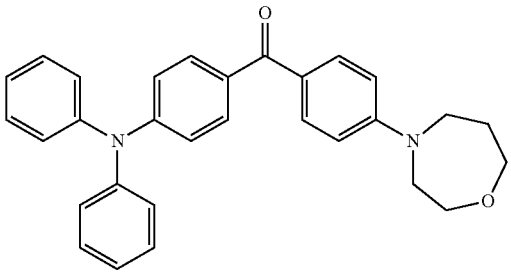
exemplary compound (83)
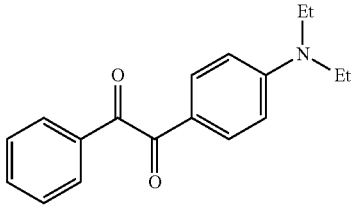
exemplary compound (84)
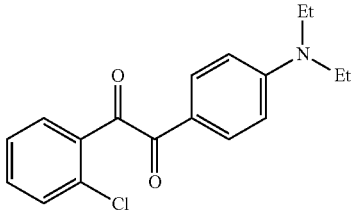
exemplary compound (85)
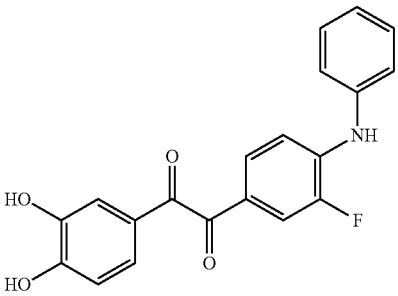
exemplary compound (86)
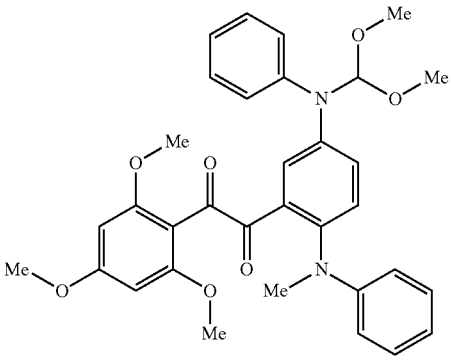
-continued
exemplary compound (87)
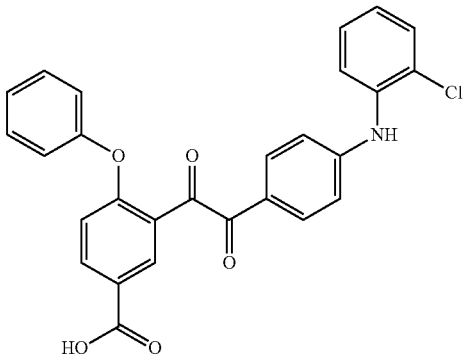
exemplay compound (88)
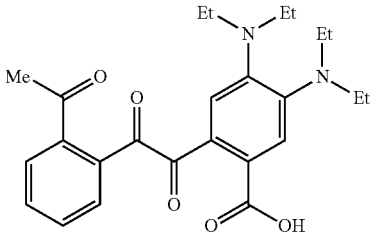
exemplary compound (89)
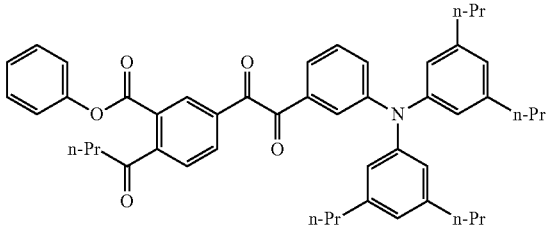
exemplary compound (90)
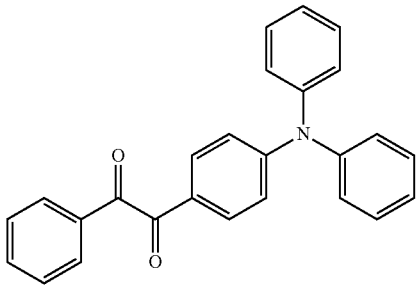
exemplary compound (91)
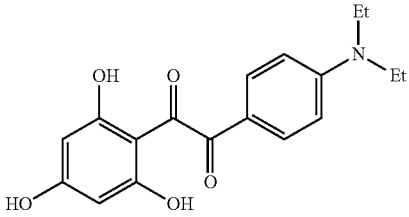

-continued
exemplary compound (92)
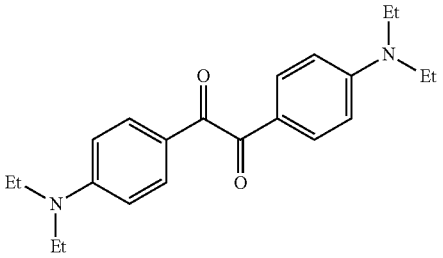
exemplary compound (93)
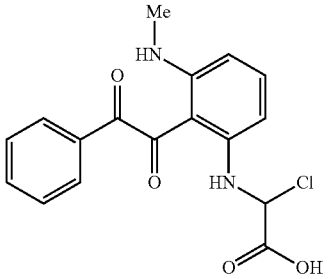
exemplary compound (94)
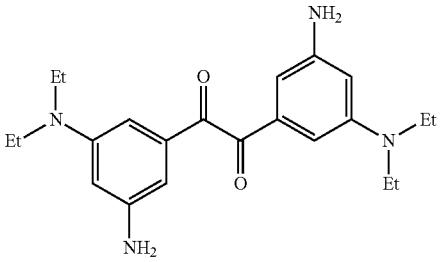
exemplary compound (95)
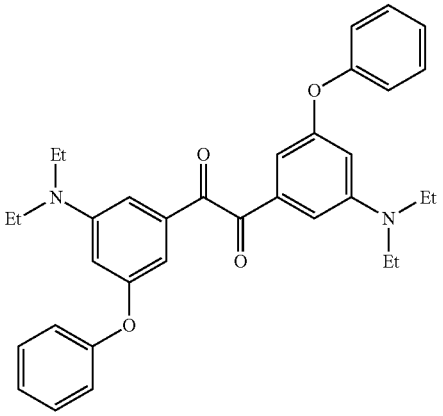
exemplary compound (96)
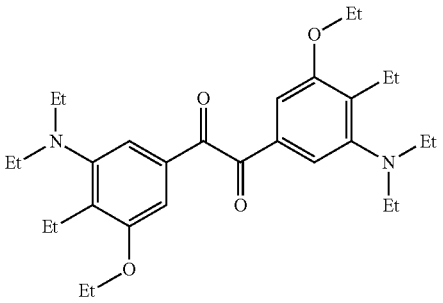
-continued
exemplary compound (97)
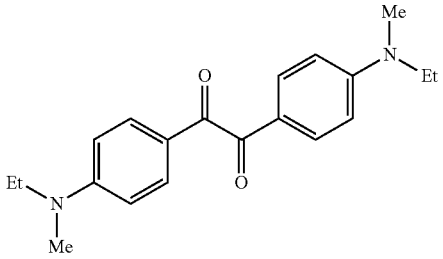
exemplary compound (98)
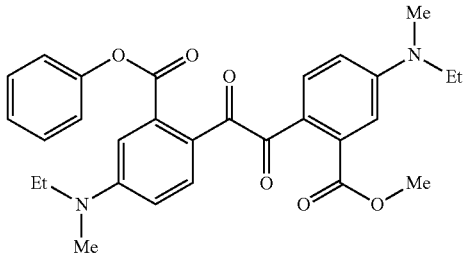
exempary compound (99)
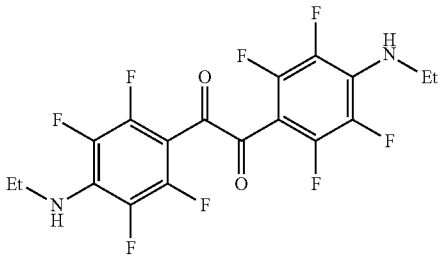
exemplary compound (100)
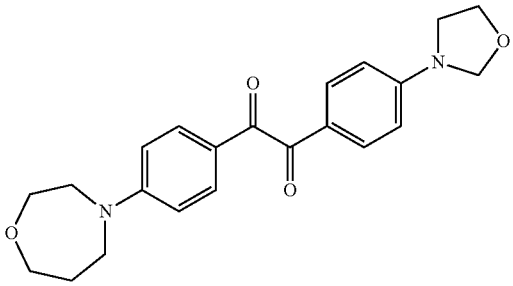
exemplary compound (101)
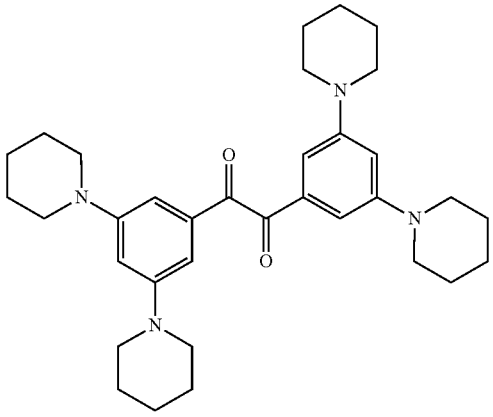

-continued
exemplary compound (102)
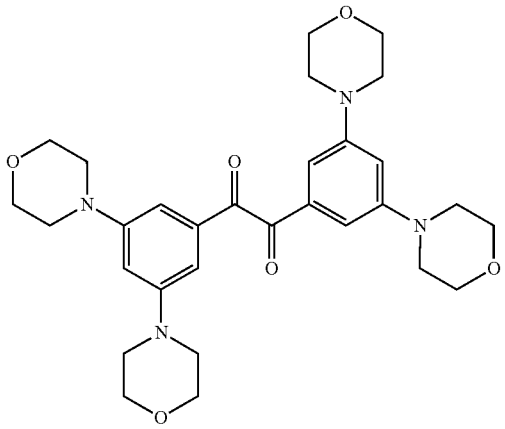
exemplary compound (103)
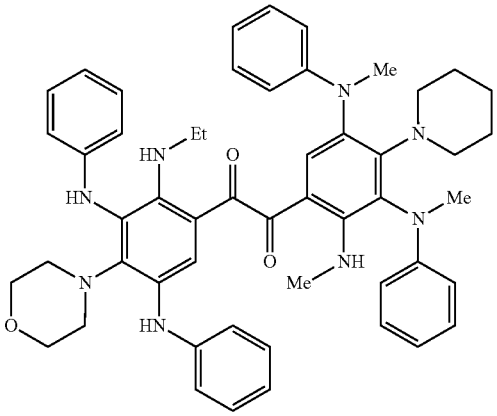
exemplary compound (104)
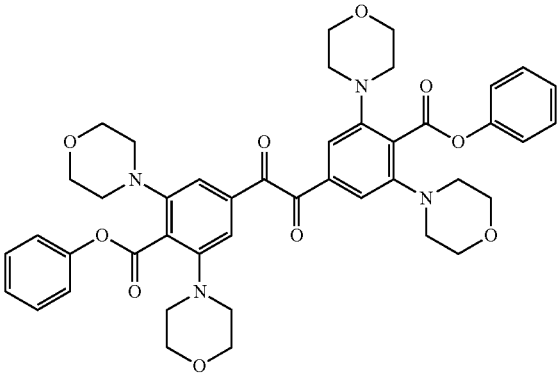
exemplary compound (105)
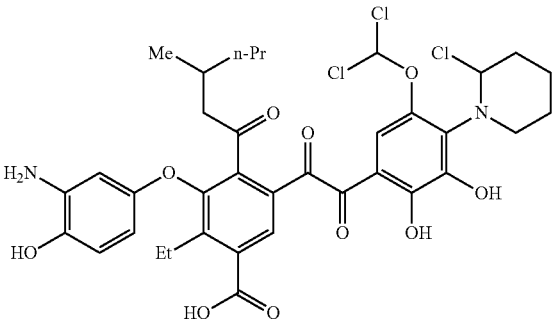
-continued
exemplary compound (106)
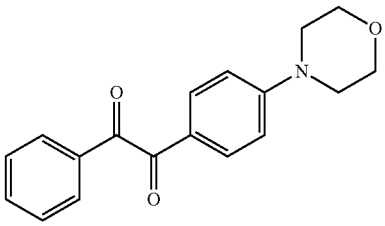
exemplary compound (107)
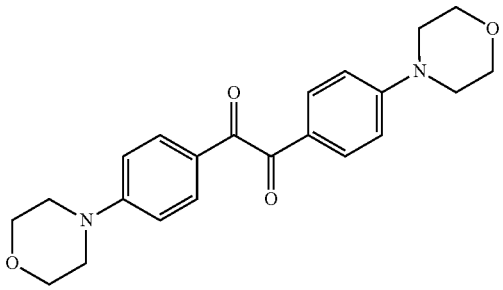
exemplary compound (108)
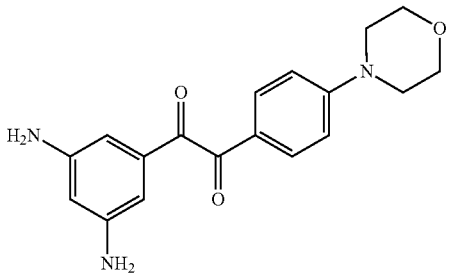
exemplary compound (109)
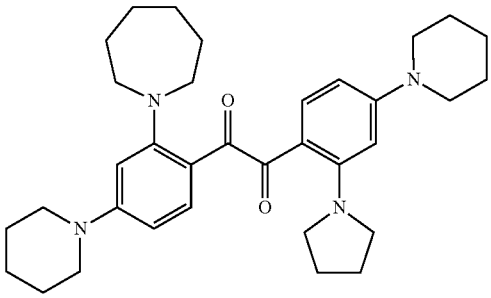
exemplary compound (110)
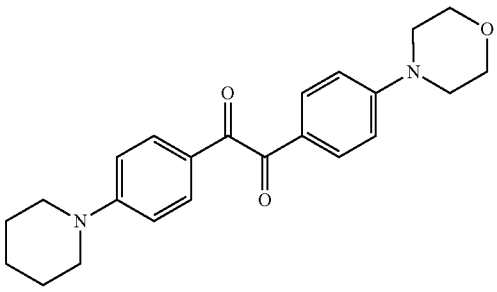

-continued exemplary compound (111)

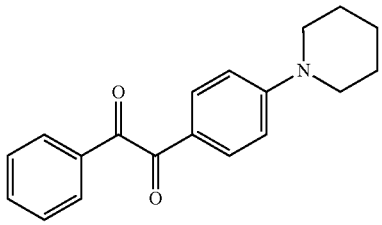

In the above exemplary compounds, Me represents a methyl group, Et represents an ethyl group and n-Pr represents a n-propyl group.

The amine compound represented by the formula (1) can also be available as a commercial product and can also be synthesized as follows.

Amino benzophenone is used as a raw material. A substitution reaction of amino benzophenone and a halide enables introducing a substituent into an amino group. In particular, a reaction of amino benzophenone and an aromatic halide using a metal catalyst is a useful method for synthesizing an amine compound substituted with an aryl group. In addition, a reaction using reductive amination is a useful method for synthesizing an amine compound substituted with an alkyl group.

Hereinafter, a specific synthesis example of the exemplary compound (27) will be described. "Part(s)" in the synthesis example means "part(s) by mass".

The IR (infrared) absorption spectrum was measured by a Fourier transform infrared spectrophotometer (trade name: FT/IR-420, manufactured by JASCO Corporation). The NMR (nuclear magnetic resonance) spectrum was measured by a nuclear magnetic resonance apparatus (trade name: EX-400, manufactured by JEOL Ltd.).

Synthesis Example

Synthesis of Exemplary Compound (27)

50 parts of N,N-dimethylacetamide, 5.0 parts of 4,4'-diamino benzophenone, 25.7 parts of iodotoluene, 9.0 parts of a copper powder and 9.8 parts of potassium carbonate were charged into a three-necked flask and refluxed for 20 hours, and thereafter a solid component was removed by hot filtration. The solvent was distilled off under reduced pressure and the residue was purified by a silica gel column (solvent: toluene) to obtain 8.1 parts of the exemplary compound (27).

Hereinafter, characteristic peaks of the IR absorption spectrum and the $^1$H-NMR spectrum obtained by the measurement are shown.

IR (cm$^{-1}$, KBr): 1646, 1594, 1508, 1318, 1277, 1174

$^1$H-NMR (ppm, $CDCl_3$, 40° C.): δ=7.63 (d, 4H), 7.11 (d, 8H), 7.04 (d, 8H), 6.93 (d, 4H), 2.33 (s, 12H)

The electrophotographic photosensitive member of the present invention is, as described above, an electrophotographic photosensitive member having a support, an undercoat layer formed on the support, and a photosensitive layer formed on the undercoat layer. The photosensitive layer may be a single layer-type photosensitive layer in which a charge generating material and a hole transporting material are comprised in a single layer, or may be a laminated layer-type photosensitive layer in which a charge generation layer comprising a charge generating material and a hole transport layer comprising a hole transporting material are laminated.

FIG. 1 is a view illustrating one example of a layer structure of an electrophotographic photosensitive member. In FIG. 1, reference numeral 101 denotes a support, reference numeral 102 denotes an undercoat layer, reference numeral 103 denotes a charge generation layer, reference numeral 104 denotes a hole transport layer and reference numeral 105 denotes a photosensitive layer (laminated layer-type photosensitive layer).

The support can be a support having conductivity (conductive support), and examples include a support made of a metal (alloy) such as aluminum, stainless steel and nickel, and a support made of a metal, plastic or paper having a conductive film provided on the surface. Examples of the shape of the support include a cylindrical shape and a film shape. In particular, a cylindrical support made of aluminum is excellent in terms of mechanical strength, electrophotographic properties and cost. A crude pipe can be used as the support as it is, or a support obtained by subjecting the surface of a crude pipe to a physical treatment such as cutting and honing, an anodization treatment, and/or a chemical treatment using an acid can be used as the support. A support obtained by subjecting a crude pipe to a physical treatment such as cutting and honing so as to have a surface roughness of 0.8 μm or more as a 10-point average roughness, Rzjis value, defined in JIS B0601:2001, has an excellent interference pattern suppression function.

A conductive layer may be provided between the support and the undercoat layer, if necessary. In particular, in the case where a crude pipe is used as the support as it is, the conductive layer can be formed on the crude pipe to thereby provide an interference pattern suppression function by a simple method. Thus, such a case is very useful in terms of productivity and cost.

The conductive layer can be formed by applying a coating liquid for a conductive layer on the support and then drying the obtained coating film. The coating liquid for a conductive layer can be prepared by subjecting conductive particles, a binder resin and a solvent to a dispersion treatment. Examples of the conductive particles include tin oxide particles, indium oxide particles, titanium oxide particles, barium sulfate particles and carbon black. The binder resin includes a phenol resin. If necessary, roughening particles may also be added to the coating liquid for a conductive layer.

The thickness of the conductive layer is preferably 5 to 40 μm and more preferably 10 to 30 μm from the viewpoints of the interference pattern suppression function and hiding (covering) of defects on the support.

The undercoat layer is provided on the support or the conductive layer.

The undercoat layer can be formed by applying on the support or the conductive layer a coating liquid for an undercoat layer prepared by dissolving the amine compound represented by the formula (1) and a resin in a solvent, and drying the obtained coating film.

Examples of the resin for use in the undercoat layer include an acrylic resin, an allyl resin, an alkyd resin, an ethylcellulose resin, an ethylene-acrylic acid copolymer, an epoxy resin, a casein resin, a silicone resin, a gelatin resin, a phenol resin, a butyral resin, a polyacrylate resin, a polyacetal resin, a polyamidimide resin, a polyamide resin, a polyallylether resin, a polyimide resin, a polyurethane resin, a polyester resin, a polyethylene resin, a polycarbonate resin, a polystyrene resin, a polysulfone resin, a polyvinyl alcohol resin, a polybutadiene resin, a polypropylene resin, a urea resin, an agarose resin and a cellulose resin. Among them, the resin can be a polyamide resin from the viewpoints of a barrier function and an adhesive function.

Examples of the solvent for use in the coating liquid for an undercoat layer include benzene, toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, propylene glycol monomethyl ether, dioxane, methylal, tetrahydrofuran, water, methanol, ethanol, n-propanol, isopropanol, butanol, methyl cellosolve, methoxypropanol, dimethylformamide, dimethylacetamide and dimethylsulfoxide.

For the purpose of controlling the resistance value of the undercoat layer to enhance potential stability, the undercoat layer may comprise metal oxide particles. Examples of the metal oxide particles include zinc oxide particles and titanium oxide particles.

The thickness of the undercoat layer can be 0.1 to 30.0 μm.

The content of the amine compound represented by the formula (1) in the undercoat layer is preferably 0.05% by mass or more and 15% by mass or less, and more preferably 0.1% by mass or more and 10% by mass or less, based on the total mass of the undercoat layer.

The amine compound represented by the formula (1) comprised in the undercoat layer may be amorphous or crystalline. The amine compound represented by the formula (1) can also be used in a combination of two or more types.

The photosensitive layer comprising a charge generating material and a hole transporting material is provided on the undercoat layer.

The charge generating material is preferably a phthalocyanine pigment or an azo pigment from the viewpoint of having a high sensitivity and, in particular, more preferably a phthalocyanine pigment.

The phthalocyanine pigment includes non-metal phthalocyanine and metal phthalocyanine, and the phthalocyanines may have an axial ligand and/or a substituent. The phthalocyanine pigment can be an oxytitanium phthalocyanine or a gallium phthalocyanine because the phthalocyanines tend to cause a ghost while having a high sensitivity and thus can enjoy the effect of the present invention. The gallium phthalocyanine can be hydroxygallium phthalocyanine or chlorogallium phthalocyanine.

The phthalocyanine pigment can be a hydroxygallium phthalocyanine crystal in the form of a crystal having strong peaks at Bragg angles 2θ of 7.4°±0.3° and 28.2°±0.3° in CuKα characteristic X-ray diffraction, a chlorogallium phthalocyanine crystal in the form of a crystal having strong peaks at Bragg angles 2θ±0.2° of 7.4°, 16.6°, 25.5° and 28.3° in CuKα characteristic X-ray diffraction, or an oxytitanium phthalocyanine crystal in the form of a crystal having a strong peak at a Bragg angle 2θ of 27.2°±0.2° in CuKα characteristic X-ray diffraction.

In particular, the phthalocyanine pigment can be a hydroxygallium phthalocyanine crystal in the form of a crystal having strong peaks at Bragg angles 2θ±0.2° of 7.3°, 24.9° and 28.1° and the strongest peak at a Bragg angle of 28.1° in CuKα characteristic X-ray diffraction or a hydroxygallium phthalocyanine crystal in the form of a crystal having strong peaks at Bragg angles 2θ±0.2° of 7.5°, 9.9°, 16.3°, 18.6°, 25.1° and 28.3° in CuKα characteristic X-ray diffraction.

In the case where the photosensitive layer is a laminated layer-type photosensitive layer, examples of a binder resin of the charge generation layer include a resin (insulating resin) such as polyvinyl butyral, polyacrylate, polycarbonate, polyester, a phenoxy resin, polyvinyl acetate, an acrylic resin, polyacrylamide, polyvinylpyridine, a cellulose-based resin, a urethane resin, an epoxy resin, an agarose resin, a cellulose resin, casein, polyvinyl alcohol and polyvinylpyrrolidone. In addition, an organic photoconductive polymer such as poly-N-vinylcarbazole, polyvinylanthracene and polyvinylpyrene can also be used.

Examples of a solvent for use in a coating liquid for a charge generation layer include toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, propylene glycol monomethyl ether, dioxane, methylal, tetrahydrofuran, water, methanol, ethanol, n-propanol, isopropanol, butanol, methyl cellosolve, methoxypropanol, dimethylformamide, dimethylacetamide and dimethylsulfoxide.

The charge generation layer can be formed by coating a coating liquid for a charge generation layer comprising the charge generating material and if necessary the binder resin, and drying the obtained coating film.

The coating liquid for a charge generation layer may be prepared by adding only the charge generating material to the solvent, subjecting the resultant to a dispersion treatment and then adding the binder resin, or may be prepared by adding the charge generating material and the binder resin together to the solvent and subjecting the resultant to a dispersion treatment.

The thickness of the charge generation layer can be 0.05 μm or more and 5 μm or less.

The content of the charge generating material in the charge generation layer is preferably 30% by mass or more and 90% by mass or less, and more preferably 50% by mass or more and 80% by mass or less, based on the total mass of the charge generation layer.

Examples of the hole transporting material include a triarylamine compound, a hydrazine compound, a stilbene compound, a pyrazoline compound, an oxazole compound, a thiazole compound and a triallylmethane compound.

In the case where the photosensitive layer is a laminated layer-type photosensitive layer, examples of a binder resin of the hole transport layer include a resin (insulating resin) such as polyvinyl butyral, polyacrylate, polycarbonate, polyester, phenoxy resin, a polyvinyl acetate, an acrylic resin, a polyacrylamide resin, a polyamide resin, polyvinylpyridine resin, a cellulose-based resin, a urethane resin, an epoxy resin, an agarose resin, a cellulose resin, casein, polyvinyl alcohol and polyvinylpyrrolidone. In addition, an organic photoconductive polymer such as poly-N-vinylcarbazole, polyvinylanthracene and polyvinylpyrene can also be used.

Examples of a solvent for use in a coating liquid for a hole transport layer include toluene, xylene, tetralin, monochlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, propylene glycol monomethyl ether, dioxane, methylal, tetrahydrofuran, water, methanol, ethanol, n-propanol, isopropanol, butanol, methyl cellosolve, methoxypropanol, dimethylformamide, dimethylacetamide and dimethylsulfoxide.

The hole transport layer can be formed by applying a coating liquid for a hole transport layer obtained by dissolving the hole transporting material and if necessary the binder resin in the solvent, and drying the obtained coating film.

The thickness of the hole transport layer can be 5 μm or more and 40 μm or less.

The content of the hole transporting material is preferably 20% by mass or more and 80% by mass or less, and more preferably 30% by mass or more and 60% by mass or less, based on the total mass of the hole transport layer.

The photosensitive layer may also comprise the amine compound represented by the formula (1). In the case where the photosensitive layer is a laminated layer-type photosensitive layer, the amine compound represented by the formula (1) can be comprised in the charge generation layer.

The amine compound represented by the formula (1) comprised in the photosensitive layer (charge generation layer) may also be amorphous or crystalline. The amine compound represented by the formula (1) can also be used in a combination of two or more types.

In the case where the photosensitive layer (charge generation layer) comprises the amine compound represented by the formula (1), the amine compound represented by the formula (1) comprised in the photosensitive layer (charge generation layer) can have the same structure as the amine compound represented by the formula (1) comprised in the undercoat layer.

For the purpose of protecting the photosensitive layer, a protective layer may be provided on the photosensitive layer.

The protective layer can be formed by applying on the photosensitive layer a coating liquid for a protective layer prepared by dissolving a resin such as polyvinyl butyral, polyester, polycarbonate (polycarbonate Z, modified polycarbonate or the like), nylon, polyimide, polyarylate, polyurethane, a styrene-butadiene copolymer, a styrene-acrylic acid copolymer or a styrene-acrylonitrile copolymer in a solvent, and drying/curing the obtained coating film. In the case of curing the coating film, heating, an electron beam or an ultraviolet ray can be used.

The thickness of the protective layer can be 0.05 to 20 μm.

The protective layer may also comprise conductive particles, an ultraviolet absorber and lubricating particles such as fluorine atom-containing resin particles. Examples of the conductive particles include metal oxide particles such as tin oxide particles.

A method for applying the coating liquid for each layer includes a dip coating method (dipping method), a spray coating method, a spinner coating method, a bead coating method, a blade coating method and a beam coating method.

Figure 2:
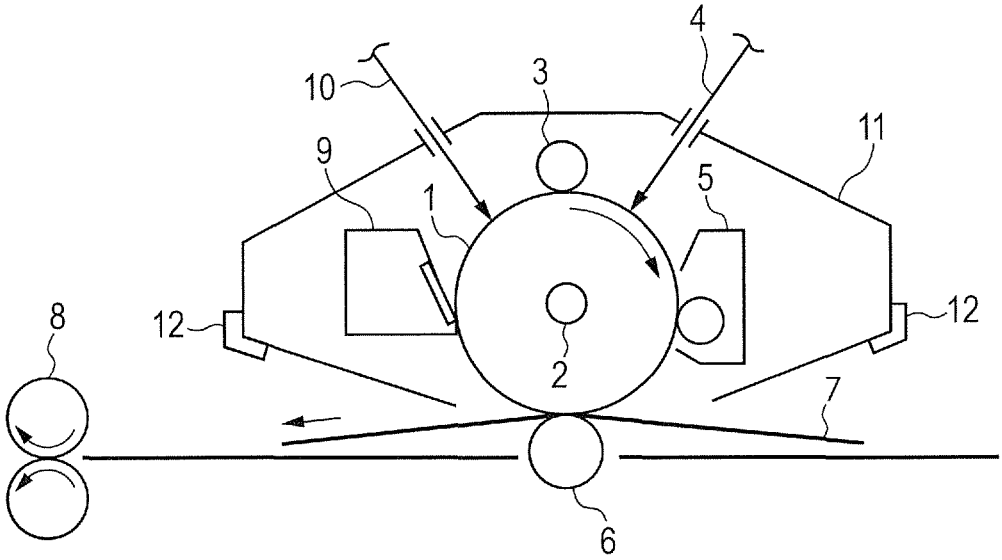
FIG. 2 is a view illustrating one example of a schematic structure of an electrophotographic apparatus provided with a process cartridge having the electrophotographic photosensitive member of the present invention.

FIG. 2 is a view illustrating one example of a schematic structure of an electrophotographic apparatus provided with a process cartridge having the electrophotographic photosensitive member of the present invention.

Reference numeral 1 denotes a cylindrical (drum-shaped) electrophotographic photosensitive member, and the member is rotationally driven around an axis 2 in an arrow direction at a predetermined circumferential velocity (process speed).

The surface of the electrophotographic photosensitive member 1 is charged at a predetermined positive or negative potential by a charging unit 3 in the course of rotation. Then, the surface of the electrophotographic photosensitive member 1 is irradiated with image exposure light 4 from an image exposure unit (not illustrated), and an electrostatic latent image corresponding to target image information is formed on the surface. The image exposure light 4 is light whose intensity is modulated in response to the time-series electrical digital image signal of the target image information, and output from an image exposure unit such as a slit exposure unit and a laser beam scanning exposure unit.

The electrostatic latent image formed on the surface of the electrophotographic photosensitive member 1 is developed (normally developed or reversely developed) by a toner received in a developing unit 5, and a toner image is formed on the surface of the electrophotographic photosensitive member 1. The toner image formed on the surface of the electrophotographic photosensitive member 1 is transferred to a transfer material 7 by a transfer unit 6. At this time, a bias voltage having a reverse polarity to a charge held by a toner is applied to the transfer unit 6 from a bias supply (not illustrated). In the case where the transfer material 7 is paper, the transfer material 7 is ejected out of a paper feeding unit (not illustrated), and sent between the electrophotographic photosensitive member 1 and the transfer unit 6 while being synchronous to the rotation of the electrophotographic photosensitive member 1.

The transfer material 7 on which the toner image is transferred from the electrophotographic photosensitive member 1 is separated from the surface of the electrophotographic photosensitive member 1, conveyed to an image fixing unit 8 and subjected to a fixing treatment of the toner image, and printed out outside an electrophotographic apparatus as an image-formed product (print, copy).

The surface of the electrophotographic photosensitive member 1 after the toner image is transferred to the transfer material 7 is cleaned by removing an adhered matter such as a toner (transfer residual toner) by a cleaning unit 9. A cleaner system has been recently developed, and thus the system can also be adopted to directly remove the transfer residual toner by a developing device and the like. Furthermore, the surface of the electrophotographic photosensitive member 1 is subjected to a neutralization treatment by pre-exposure light 10 from a pre-exposure unit (not illustrated), and then repeatedly used for image forming. It is to be noted that in the case where the charging unit 3 is a contact charging unit using a charging roller, the pre-exposure unit is not necessarily required.

In the present invention, a plurality of components selected from components such as the electrophotographic photosensitive member 1, the charging unit 3, the developing unit 5 and the cleaning unit 9 are accommodated in a container and integrally supported to form a process cartridge, and the process cartridge can be configured to be detachably mountable to a main body of an electrophotographic apparatus. Such a configuration is, for example, as follows. At least one component selected from the charging unit 3, the developing unit 5 and the cleaning unit 9 is integrally supported with the electrophotographic photosensitive member 1 to form a cartridge. The cartridge can be formed into a process cartridge 11 detachably mountable to a main body of an electrophotographic apparatus by using a guide unit 12 such as a rail in the main body of the electrophotographic apparatus.

The image exposure light 4 may be reflected light or transmitted light from a manuscript in the case where the electrophotographic apparatus is a copier or a printer. Alternatively, the image exposure light 4 may be light emitted by reading and signalizing a manuscript by a sensor, and scanning a laser beam, driving an LED array, or driving a liquid crystal shutter array, carried out according to the signal.

The electrophotographic photosensitive member of the present invention can widely be applied in the electrophotographic application field such as a laser beam printer, a CRT printer, an LED printer, FAX, a liquid crystal printer and laser plate making.

Hereinafter, the present invention will be described in more detail with reference to specific Examples. However, the present invention is not limited to the Examples. Herein, the thickness of each layer of an electrophotographic photosensitive member in each of Examples and Comparative Examples was measured by an eddy current thickness meter (Fischerscope, manufactured by Fischer Instruments K.K.) or calculated from the mass per unit area in terms of specific weight. "Part(s)" in Examples means "parts by mass".

EXAMPLE 1

An aluminum cylinder having a diameter of 24 mm and a length of 257 mm was used as a support (cylindrical support).

Then, 60 parts of barium sulfate particles covered with tin oxide (trade name: Pastlan PC1, produced by Mitsui Mining & Smelting Co., Ltd.), 15 parts of titanium oxide particles (trade name: TITANIX JR, produced by Tayca Corporation), 43 parts of a resol-type phenol resin (trade name: PHENOLITE J-325, produced by DIC Corporation, solid content: 70% by mass), 0.015 parts of a silicone oil (trade name: SH28PA, produced by Toray Silicone Co., Ltd.), 3.6 parts of silicone resin particles (trade name: TOSPEARL 120, produced by Toshiba Silicone Co., Ltd.), 50 parts of 2-methoxy-1-propanol and 50 parts of methanol were charged into a ball mill and subjected to a dispersion treatment for 20 hours, thereby preparing a coating liquid for a conductive layer. The coating liquid for a conductive layer was applied by dipping on the support, and the obtained coating film was heated at 140° C. for 1 hour and cured, thereby forming a conductive layer having a thickness of 20 μm.

Then, a solution formed by dissolving 25 parts of N-methoxymethylated nylon 6 (trade name: Toresin EF-30T, produced by Nagase ChemteX Corporation) in a mixed solvent of 320 parts of methanol/160 parts of n-butanol (heating and dissolving at 65° C.) was cooled. Thereafter, the solution was filtrated by a membrane filter (trade name: FP-022, pore size: 0.22 μm, manufactured by Sumitomo Electric Industries) and 0.5 parts of an exemplary compound (1) (product code: 159400050, produced by Acros Organics) was added to the filtrate, thereby preparing a coating liquid for an undercoat layer. The coating liquid for an undercoat layer was applied by dipping on the conductive layer and the obtained coating film was dried at 100° C. for 10 minutes, thereby forming an undercoat layer having a thickness of 0.45 μm.

Then, 20 parts of a hydroxygallium phthalocyanine crystal in the form of a crystal having strong peaks at Bragg angles 2θ±0.2° of 7.3°, 24.9° and 28.1° and the strongest peak at a Bragg angle of 28.1° in CuKα characteristic X-ray diffraction (charge generating material), 0.2 parts of a calixarene compound represented by the following formula (5), (5)

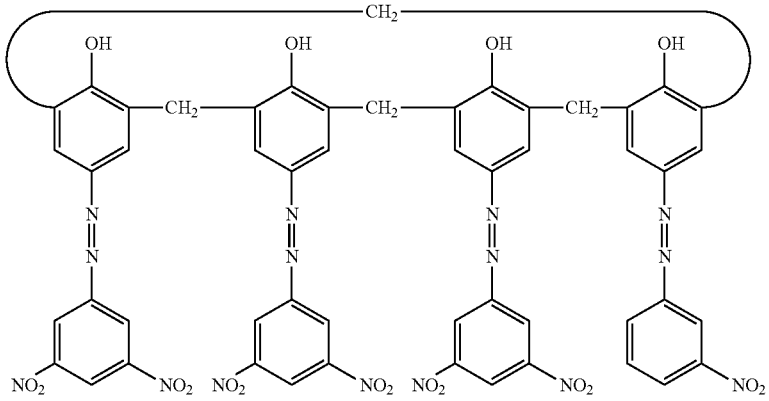

10 parts of polyvinyl butyral (trade name: BX-1, produced by Sekisui Chemical Co., Ltd.) and 519 parts of cyclohexanone were charged into a sand mill using glass beads having a diameter of 1 mm and subjected to a dispersion treatment for 4 hours, and then 764 parts of ethyl acetate was added, thereby preparing a coating liquid for a charge generation layer. The coating liquid for a charge generation layer was applied by dipping on the undercoat layer and the obtained coating film was dried at 100° C. for 10 minutes, thereby forming a charge generation layer having a thickness of 0.18 μm.

Then, 70 parts of a triarylamine compound represented by the following formula (6) (hole transporting material), (6)

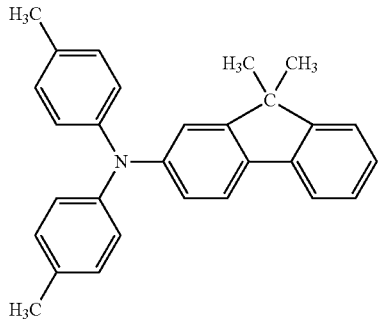

10 parts of a triarylamine compound represented by the following formula (7) (hole transporting material), (7)

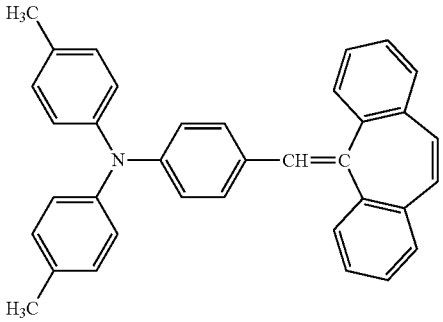

and 100 parts of polycarbonate (trade name: Iupiron Z-200, produced by Mitsubishi Engineering-Plastics Corporation) were dissolved in 630 parts of monochlorobenzene, thereby preparing a coating liquid for a hole transport layer. The coating liquid for a hole transport layer was applied by dipping on the charge generation layer and the obtained coating film was dried at 120° C. for 1 hour, thereby forming a hole transport layer having a thickness of 19 μm.

The coating films for the conductive layer, the undercoat layer, the charge generation layer and the hole transport layer were dried using an oven set at each temperature. The same will apply hereinafter.

As described above, a cylindrical (drum-shaped) electrophotographic photosensitive member in Example 1 was produced.

EXAMPLE 2

An electrophotographic photosensitive member in Example 2 was produced in the same manner as in Example 1 except that the amount of the exemplary compound (1) used in preparing a coating liquid for an undercoat layer was changed from 0.5 parts to 0.005 parts in Example 1.

EXAMPLE 3

An electrophotographic photosensitive member in Example 3 was produced in the same manner as in Example 1 except that the amount of the exemplary compound (1) used in preparing a coating liquid for an undercoat layer was changed from 0.5 parts to 0.05 parts in Example 1.

EXAMPLE 4

An electrophotographic photosensitive member in Example 4 was produced in the same manner as in Example 1 except that the amount of the exemplary compound (1) used in preparing a coating liquid for an undercoat layer was changed from 0.5 parts to 1.25 parts in Example 1.

EXAMPLE 5

An electrophotographic photosensitive member in Example 5 was produced in the same manner as in Example 1 except that the amount of the exemplary compound (1) used in preparing a coating liquid for an undercoat layer was changed from 0.5 parts to 2.5 parts in Example 1.

EXAMPLE 6

An electrophotographic photosensitive member in Example 6 was produced in the same manner as in Example 1 except that the amount of the exemplary compound (1) used in preparing a coating liquid for an undercoat layer was changed from 0.5 parts to 5 parts in Example 1.

EXAMPLE 7

An electrophotographic photosensitive member in Example 7 was produced in the same manner as in Example 1 except that the amount of the exemplary compound (1) used in preparing a coating liquid for an undercoat layer was changed from 0.5 parts to 0.25 parts and the preparation of a coating liquid for a charge generation layer was changed as follows in Example 1.

Twenty parts of a hydroxygallium phthalocyanine crystal in the form of a crystal having strong peaks at Bragg angles 2θ±0.2° of 7.3°, 24.9° and 28.1° and the strongest peak at a Bragg angle of 28.1° in CuKα characteristic X-ray diffraction (charge generating material), 0.2 parts of the calixarene compound by the formula (5), 2 parts of the exemplary compound (1) (product code: 159400050, produced by Acros Organics), 10 parts of polyvinyl butyral (trade name: BX-1, produced by Sekisui Chemical Co., Ltd.) and 553 parts of cyclohexanone were charged into a sand mill using glass beads having a diameter of 1 mm and subjected to a dispersion treatment for 4 hours, and then 815 parts of ethyl acetate was added, thereby preparing a coating liquid for a charge generation layer.

EXAMPLE 8

An electrophotographic photosensitive member in Example 8 was produced in the same manner as in Example 7 except that 0.25 parts of the exemplary compound (1) used in preparing a coating liquid for an undercoat layer was changed to 0.025 parts of an exemplary compound (2) (product code: B1275, produced by Tokyo Chemical Industry Co., Ltd.) and 2 parts of the exemplary compound (1) used in preparing a coating liquid for a charge generation layer was changed to 0.1 parts of an exemplary compound (2) in Example 7.

EXAMPLE 9

An electrophotographic photosensitive member in Example 9 was produced in the same manner as in Example 8 except that the amount of the exemplary compound (2) used in preparing a coating liquid for an undercoat layer was changed from 0.025 parts to 0.05 parts and the exemplary compound (2) was not used in preparing a coating liquid for a charge generation layer in Example 8.

EXAMPLE 10

An electrophotographic photosensitive member in Example 10 was produced in the same manner as in Example 8 except that the undercoat layer was formed as follows in Example 8.

36 parts of an alkyd resin (trade name: Beckolite M6401-50-S (solid content: 50%), produced by DIC Corporation), 20 parts of a melamine resin (trade name: Superbeckamine L-121-60 (solid content: 60%), produced by DIC Corporation), 120 parts of surface-untreated rutile type titanium oxide particles (trade name: CR-EL, average particle size: 0.25 μm, produced by Ishihara Sangyo Kaisha Ltd.) (product code: B1275, produced by Tokyo Chemical Industry Co., Ltd.), 0.12 parts of the exemplary compound (2) and 280 parts of 2-butanone were used to prepare a coating liquid for an undercoat layer. The coating liquid for an undercoat layer was applied by dipping on the conductive layer and the obtained coating film was dried at 130° C. for 45 minutes, thereby forming an undercoat layer having a thickness of 3 μm.

EXAMPLE 11

An electrophotographic photosensitive member in Example 11 was produced in the same manner as in Example 10 except that the amount of the exemplary compound (2) used in preparing a coating liquid for an undercoat layer was changed from 0.12 parts to 0.24 parts and the exemplary compound (2) was not used in preparing a coating liquid for a charge generation layer in Example 10.

EXAMPLE 12

An aluminum cylinder having a diameter of 30 mm and a length of 357.5 mm was used as a support (cylindrical support).

Then, 56 parts of a butyral resin (trade name: BM-1, produced by Sekisui Chemical Co., Ltd.), 56 parts of a blocked isocyanate (trade name: Sumijule 3175, produced by Sumitomo Bayer Urethane Co., Ltd.), 300 parts of zinc oxide particles whose surfaces had been treated with N-2-(aminoethyl)-3-aminopropylmethyldimethoxysilane (silane coupling agent, trade name: KBM602, produced by Shin-Etsu Chemical Co., Ltd.), 3 parts of the exemplary compound (2) (product code: B1275, produced by Tokyo Chemical Industry Co., Ltd.), 298 parts of 2-butanone and 298 parts of n-butanol were charged into a sand mill using glass beads having a diameter of 1 mm and subjected to a dispersion treatment for 3.3 hours. Thereafter, 0.04 parts of a silicone oil (trade name: SH28PA, produced by Dow Corning Toray Silicone Co., Ltd.) and 21 parts of polymethylmethacrylate resin (PMMA) particles (trade name: SSX-102, produced by Sekisui Plastics Co., Ltd., average particle size: 2.5 μm) were added thereto, thereby preparing a coating liquid for an undercoat layer. The coating liquid for an undercoat layer was applied by dipping on the support and the obtained coating film was dried at 160° C. for 30 minutes, thereby forming an undercoat layer having a thickness of 16 μm.

Then, a charge generation layer and a hole transport layer were formed in the same manner as in Example 8, thereby producing an electrophotographic photosensitive member in Example 12.

EXAMPLE 13

An electrophotographic photosensitive member in Example 13 was produced in the same manner as in Example 12 except that the amount of the exemplary compound (2) used in preparing a coating liquid for an undercoat layer was changed from 3 parts to 6 parts and the exemplary compound (2) was not used in preparing a coating liquid for a charge generation layer in Example 12.

EXAMPLE 14

An electrophotographic photosensitive member in Example 14 was produced in the same manner as in Example 7 except that the amount of the exemplary compound (1) used in preparing a coating liquid for an undercoat layer was changed from 0.25 parts to 0.125 parts and 2 parts of the exemplary compound (1) used in preparing a coating liquid for a charge generation layer was changed to 0.1 parts of the exemplary compound (2) in Example 7.

EXAMPLE 15

An electrophotographic photosensitive member in Example 15 was produced in the same manner as in Example 1 except that the exemplary compound (1) used in preparing a coating liquid for an undercoat layer was changed to an exemplary compound (3) (product code: B1212, produced by Tokyo Chemical Industry Co., Ltd.) in Example 1.

EXAMPLE 16

An electrophotographic photosensitive member in Example 16 was produced in the same manner as in Example 1 except that the exemplary compound (1) used in preparing a coating liquid for an undercoat layer was changed to an exemplary compound (4) (product code: B1433, produced by Tokyo Chemical Industry Co., Ltd.) in Example 1.

EXAMPLE 17

An electrophotographic photosensitive member in Example 17 was produced in the same manner as in Example 7 except that the exemplary compound (1) used in preparing a coating liquid for an undercoat layer was changed to an exemplary compound (5) (product code: D2561, produced by Tokyo Chemical Industry Co., Ltd.) in Example 7.

EXAMPLE 18

An electrophotographic photosensitive member in Example 18 was produced in the same manner as in Example 1 except that the exemplary compound (1) used in preparing a coating liquid for an undercoat layer was changed to an exemplary compound (9) in Example 1.

EXAMPLE 19

An electrophotographic photosensitive member in Example 19 was produced in the same manner as in Example 1 except that the exemplary compound (1) used in preparing a coating liquid for an undercoat layer was changed to an exemplary compound (12) in Example 1.

EXAMPLE 20

An electrophotographic photosensitive member in Example 20 was produced in the same manner as in Example 1 except that the exemplary compound (1) used in preparing a coating liquid for an undercoat layer was changed to an exemplary compound (14) in Example 1.

EXAMPLE 21

An electrophotographic photosensitive member in Example 21 was produced in the same manner as in Example 7 except that the exemplary compound (1) used in preparing a coating liquid for an undercoat layer was changed to an exemplary compound (18) in Example 7.

EXAMPLE 22

An electrophotographic photosensitive member in Example 22 was produced in the same manner as in Example 1 except that the exemplary compound (1) used in preparing a coating liquid for an undercoat layer was changed to an exemplary compound (27) in Example 1.

EXAMPLE 23

An electrophotographic photosensitive member in Example 23 was produced in the same manner as in Example 1 except that the charge generation layer was formed as follows in Example 1.

Twenty parts of an oxytitanium phthalocyanine crystal in the form of a crystal having strong peaks at Bragg angles $2\theta \pm 0.2°$ of 9.0°, 14.2°, 23.9° and 27.1° in CuKα characteristic X-ray diffraction (charge generating material), 10 parts of polyvinyl butyral (trade name: BX-1, produced by Sekisui Chemical Co., Ltd.) and 519 parts of cyclohexanone were charged into a sand mill using glass beads having a diameter of 1 mm and subjected to a dispersion treatment for 4 hours, and then 764 parts of ethyl acetate was added, thereby preparing a coating liquid for a charge generation layer. The coating liquid for a charge generation layer was applied by dipping on the undercoat layer and dried at 100° C. for 10 minutes, thereby preparing a charge generation layer having a thickness of 0.18 μm.

COMPARATIVE EXAMPLE 1

An electrophotographic photosensitive member in Comparative Example 1 was produced in the same manner as in Example 1 except that the exemplary compound (1) was not used in preparing a coating liquid for an undercoat layer in Example 1.

COMPARATIVE EXAMPLE 2

An electrophotographic photosensitive member in Comparative Example 2 was produced in the same manner as in Example 1 except that the exemplary compound (1) used in preparing a coating liquid for an undercoat layer was changed to a bisazo pigment represented by the following formula (8) in Example 1.

(8)

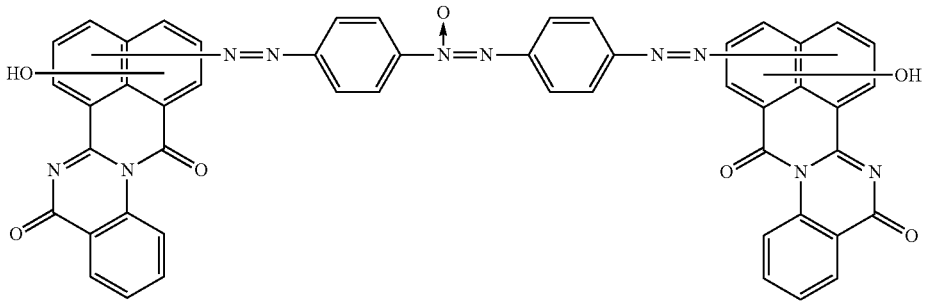

COMPARATIVE EXAMPLE 3

An electrophotographic photosensitive member in Comparative Example 3 was produced in the same manner as in Example 1 except that the exemplary compound (1) used in preparing a coating liquid for an undercoat layer was changed to a benzophenone compound represented by the following formula (9) (product code: 378259, produced by Sigma-Aldrich) in Example 1.

(9)

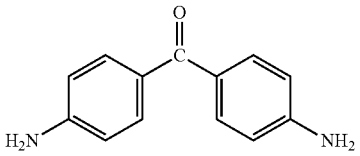

COMPARATIVE EXAMPLE 4

An electrophotographic photosensitive member in Comparative Example 4 was produced in the same manner as in Example 7 except that the exemplary compound (1) used in preparing a coating liquid for an undercoat layer was changed to a compound represented by the following formula (10) (product code: B0483, produced by Tokyo Chemical Industry Co., Ltd.) in Example 7.

(10)

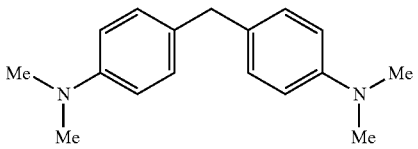

Where, in the formula (10), Me represents a methyl group.

COMPARATIVE EXAMPLE 5

An electrophotographic photosensitive member in Comparative Example 5 was produced in the same manner as in Example 1 except that the exemplary compound (1) used in preparing a coating liquid for an undercoat layer was changed to an anthraquinone compound represented by the following formula (11) in Example 1.

(11)

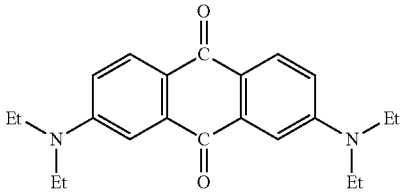

Where, in the formula (11), Et represents an ethyl group.

COMPARATIVE EXAMPLE 6

An electrophotographic photosensitive member in Comparative Example 6 was produced in the same manner as in Example 1 except that the exemplary compound (1) used in preparing a coating liquid for an undercoat layer was changed to a benzophenone compound represented by the following formula (12) (product code: 126217, produced by Sigma-Aldrich) in Example 1.

(12)

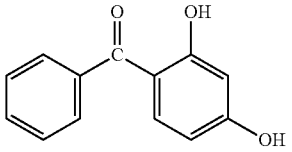

COMPARATIVE EXAMPLE 7

An electrophotographic photosensitive member in Comparative Example 7 was produced in the same manner as in Example 7 except that the exemplary compound (1) used in preparing a coating liquid for an undercoat layer was changed to a benzophenone compound represented by the following formula (13) in Example 7.

(13)

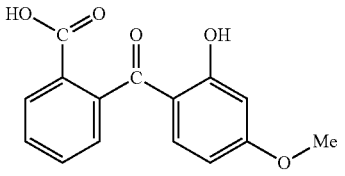

Where, in the formula (13), Me represents a methyl group.

COMPARATIVE EXAMPLE 8

An electrophotographic photosensitive member in Comparative Example 8 was produced in the same manner as in Example 11 except that the exemplary compound (2) used in preparing a coating liquid for an undercoat layer was changed to a benzophenone compound represented by the following formula (14) (product code: D1688, produced by Tokyo Chemical Industry Co., Ltd.) in Example 11.

(14)

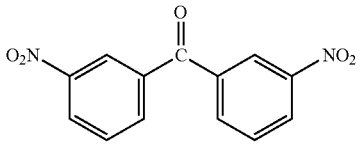

COMPARATIVE EXAMPLE 9

An electrophotographic photosensitive member in Comparative Example 9 was produced in the same manner as in Example 13 except that the exemplary compound (2) used in preparing a coating liquid for an undercoat layer was changed to benzophenone represented by the following formula (15) (product code: B0083, produced by Tokyo Chemical Industry Co., Ltd.) in Example 13.

(15)

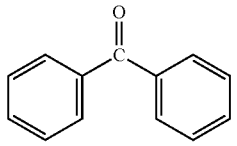

COMPARATIVE EXAMPLE 10

An electrophotographic photosensitive member in Comparative Example 10 was produced in the same manner as in Example 11 except that the exemplary compound (2) was not used in preparing a coating liquid for an undercoat layer in Example 11.

COMPARATIVE EXAMPLE 11

An electrophotographic photosensitive member in Comparative Example 11 was produced in the same manner as in Example 13 except that the exemplary compound (2) was not used in preparing a coating liquid for an undercoat layer in Example 13.

COMPARATIVE EXAMPLE 12

An electrophotographic photosensitive member in Comparative Example 12 was produced in the same manner as in Example 23 except that the exemplary compound (1) was not used in preparing a coating liquid for an undercoat layer and in preparing a coating liquid for a charge generation layer in Example 23.

Evaluations of Examples 1 to 23 and Comparative Examples 1 to 12

In the electrophotographic photosensitive members in Examples 1 to 23 and Comparative Examples 1 to 12, the evaluation of a ghost was performed under an ordinary temperature and ordinary humidity environment, 23° C./50% RH, and under a low temperature and low humidity environment, 15° C./10% RH.

As an electrophotographic apparatus for the evaluation, an altered machine of a laser beam printer manufactured by Hewlett-Packard Development Company, L.P. (trade name: Color Laser Jet CP3525dn) was used with respect to the electrophotographic photosensitive members in Examples 1 to 11, 14 to 23 and Comparative Examples 1 to 8, 10, 12. The laser beam printer was altered so that pre-exposure light was not turned on and the altered machine was operated under a variable charging condition and in a variable laser exposure amount, and in addition, the produced electrophotographic photosensitive member was attached to a process cartridge for a cyan color, the resultant was mounted on the station of the process cartridge for a cyan color, and process cartridges for other colors were operated even if being not attached to the main body of the laser beam printer.

On the other hand, an altered machine of a copier manufactured by Canon Kabushiki Kaisha (trade name: imageRUNNER iR-ADV C5051) was used for the electrophotographic photosensitive members in Examples 12 and 13 and Comparative Examples 9 and 11. The copier was altered so that the altered machine was operated under a variable charging condition and in a variable laser exposure amount, and in addition, the produced electrophotographic photosensitive member was attached to a process cartridge for a cyan color, the resultant was mounted on the station of the process cartridge for a cyan color, and process cartridges for other colors were operated even if being not attached to the main body of the copier.

When an image was output, only the process cartridge for a cyan color was mounted on the main body of the laser beam printer or the main body of the copier to output a single color image by only a cyan toner.

The surface potential of each electrophotographic photosensitive member was set so that the initial dark area potential was −500V and the light area potential was −150V with respect to Examples 1 to 11, 14 to 23 and Comparative Examples 1 to 8, 10, 12, and on the other hand, the initial dark area potential was −600V and the light area potential was −250V with respect to Examples 12 and 13 and Comparative Examples 9 and 11. When the potential was set, the surface potential of each electrophotographic photosensitive member was determined by using a potential probe (trade name: model 6000B-8, manufactured by Trek Japan KK) attached at the developing position of the process cartridge and a surface electrometer (trade name: model 344, manufactured by Trek Japan KK), to measure a potential at the center portion in the longitudinal direction of the electrophotographic photosensitive member.

First, the evaluation of a ghost was performed under an ordinary temperature and ordinary humidity environment, 23° C./50% RH. Thereafter, a duration test in which 1,000 sheets of paper were passed was performed under the same environment, and the evaluation of a ghost was performed immediately after the duration test. The evaluation results under an ordinary temperature and ordinary humidity environment are shown in Table 1.

Then, the electrophotographic photosensitive member was left to stand together with the electrophotographic apparatus for the evaluation under a low temperature and low humidity environment, 15° C./10% RH, for 3 days, and then the evaluation of a ghost was performed. Then, a duration test in which 1,000 sheets of paper were passed was performed under the same environment, and the evaluation of a ghost was performed immediately after the duration test. The evaluation results under a low temperature and low humidity environment are shown in Table 1.

At the time of such paper-passing duration test, an E-letter image having a print percentage of 1% was formed on A4-size plain paper by a single color, cyan.

The evaluation criteria are as follows.

Figure 3:
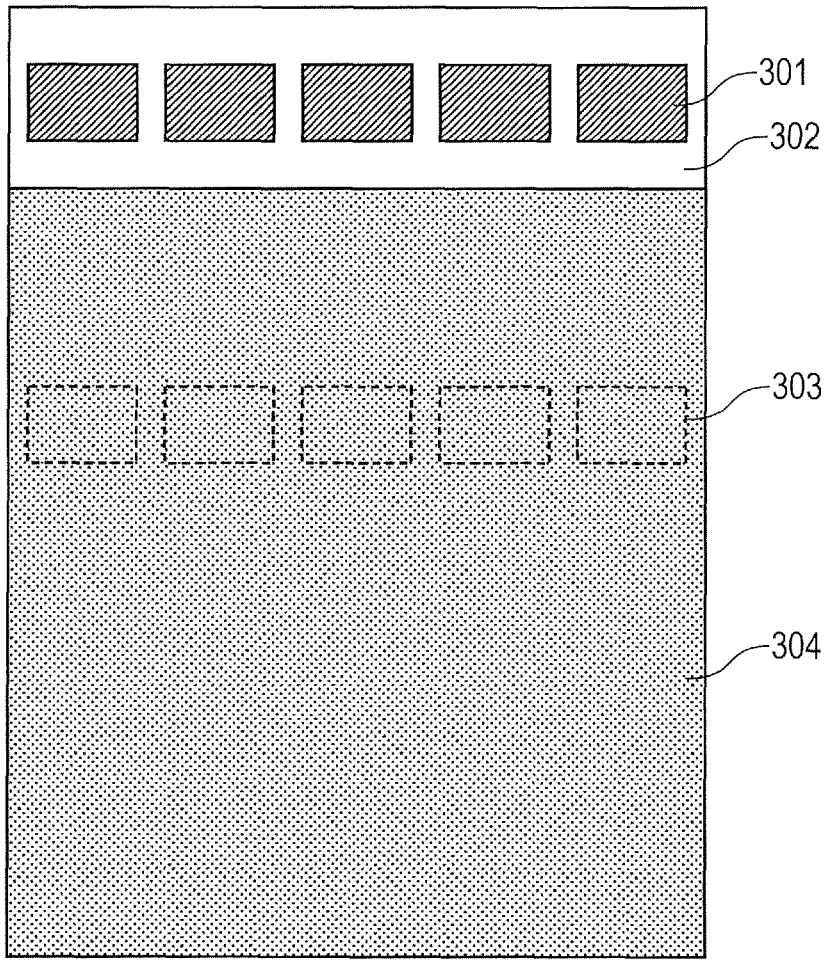
FIG. 3 is a view illustrating an image for evaluating a ghost.

An image for evaluating a ghost was formed by outputting a square image of solid black 301 on the head of an image and then outputting a halftone image 304 of a 1-dot KEIMA (knight of Japanese chess) pattern as shown FIG. 3. The image was output by first outputting a solid white image on the first sheet, thereafter, continuously outputting an image for evaluating a ghost on 5 sheets, then outputting a solid black image on 1 sheet, and outputting an image for evaluation of a ghost on 5 sheets again, in this order, and such ten images for evaluating a ghost in total were evaluated.

The evaluation of a ghost was performed by measuring the density difference between the image density of a 1-dot KEIMA (knight of Japanese chess) pattern and the image density of a ghost region (region where a ghost could occur) by a spectral densitometer (trade name: X-Rite 504/508, manufactured by X-Rite, Incorporated). Ten points of one image for evaluating a ghost were measured and the average of such ten points was defined as a result of one image. All the ten images for evaluating a ghost were subjected to the same measurement and then the respective averages were determined and defined as the density differences of the respective Examples. The density difference indicates that the smaller value exhibits a lower degree of ghost and is more favorable. In Table 1, the "initial" means the density difference before performing the duration test in which 1,000 sheets of paper were passed under an ordinary temperature and ordinary humidity environment or under a low temperature and low humidity environment, and the "after duration" means the density difference after performing the duration test in which 1,000 sheets of paper were passed under an ordinary temperature and ordinary humidity environment or under a low temperature and low humidity environment.

TABLE 1

| | Density difference | | | |
|---|---|---|---|---|
| | Under ordinary temperature and ordinary humidity environment | | Under low temperature and low humidity environment | |
| | Initial | After duration | Initial | After duration |
| Example 1 | 0.026 | 0.030 | 0.029 | 0.033 |
| Example 2 | 0.029 | 0.036 | 0.034 | 0.042 |
| Example 3 | 0.028 | 0.031 | 0.031 | 0.036 |
| Example 4 | 0.027 | 0.032 | 0.030 | 0.037 |
| Example 5 | 0.029 | 0.034 | 0.032 | 0.038 |
| Example 6 | 0.031 | 0.035 | 0.034 | 0.040 |
| Example 7 | 0.019 | 0.022 | 0.021 | 0.024 |
| Example 8 | 0.019 | 0.025 | 0.022 | 0.027 |
| Example 9 | 0.025 | 0.030 | 0.029 | 0.035 |
| Example 10 | 0.021 | 0.024 | 0.024 | 0.028 |
| Example 11 | 0.026 | 0.029 | 0.030 | 0.034 |
| Example 12 | 0.021 | 0.026 | 0.024 | 0.029 |
| Example 13 | 0.026 | 0.029 | 0.029 | 0.034 |
| Example 14 | 0.024 | 0.028 | 0.026 | 0.032 |
| Example 15 | 0.025 | 0.030 | 0.029 | 0.034 |
| Example 16 | 0.027 | 0.033 | 0.032 | 0.038 |
| Example 17 | 0.024 | 0.028 | 0.026 | 0.031 |
| Example 18 | 0.028 | 0.034 | 0.033 | 0.038 |
| Example 19 | 0.031 | 0.036 | 0.035 | 0.042 |
| Example 20 | 0.027 | 0.033 | 0.030 | 0.037 |

TABLE 1-continued

| | Density difference | | | |
|---|---|---|---|---|
| | Under ordinary temperature and ordinary humidity environment | | Under low temperature and low humidity environment | |
| | Initial | After duration | Initial | After duration |
| Example 21 | 0.023 | 0.029 | 0.026 | 0.032 |
| Example 22 | 0.029 | 0.035 | 0.033 | 0.040 |
| Example 23 | 0.029 | 0.031 | 0.032 | 0.037 |
| Comparative Example 1 | 0.039 | 0.052 | 0.045 | 0.104 |
| Comparative Example 2 | 0.042 | 0.065 | 0.048 | 0.126 |
| Comparative Example 3 | 0.040 | 0.058 | 0.045 | 0.116 |
| Comparative Example 4 | 0.037 | 0.056 | 0.043 | 0.109 |
| Comparative Example 5 | 0.037 | 0.051 | 0.042 | 0.101 |
| Comparative Example 6 | 0.040 | 0.061 | 0.046 | 0.122 |
| Comparative Example 7 | 0.036 | 0.052 | 0.041 | 0.104 |
| Comparative Example 8 | 0.041 | 0.060 | 0.048 | 0.118 |
| Comparative Example 9 | 0.039 | 0.058 | 0.044 | 0.115 |
| Comparative Example 10 | 0.036 | 0.055 | 0.043 | 0.110 |
| Comparative Example 11 | 0.038 | 0.055 | 0.045 | 0.108 |
| Comparative Example 12 | 0.041 | 0.062 | 0.048 | 0.122 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-262024, filed Nov. 30, 2011, and Japanese Patent Application No. 2012-251040, filed Nov. 15, 2012 which are hereby incorporated by reference herein in their entirety.

What is claimed is:

1. An electrophotographic photosensitive member comprising a support, an undercoat layer formed on the support, and a photosensitive layer formed on the undercoat layer and comprising a charge generating material and a hole transporting material, wherein the undercoat layer comprises an amine compound represented by the following formula (1):

(1)

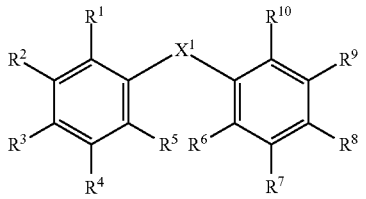

where, in the formula (1), $R^1$ to $R^{10}$ each independently represent a hydrogen atom, a halogen atom, a hydroxy group, a carboxyl group, an alkoxycarbonyl group, an aryloxycarbonyl group, a substituted or unsubstituted acyl group, a substituted or unsubstituted alkyl group, a substituted or unsubstituted alkoxy group, a substituted or unsubstituted aryloxy group, a substituted or unsubstituted amino group, or a substituted or unsubstituted cyclic amino group, provided that at least one of $R^1$ to $R^{10}$ represents a substituted or unsubstituted morpholino group or a substituted or unsubstituted 1-piperidyl group; and $X^1$ represents a carbonyl group or a dicarbonyl group.

2. The electrophotographic photosensitive member according to claim 1, wherein the amine compound represented by the formula (1) is an amine compound represented by any of the following formulas (2) to (4):

(2)

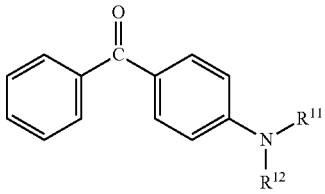

(3)

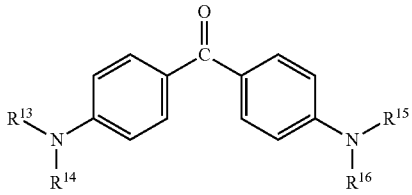

(4)

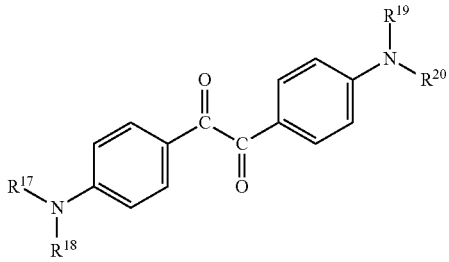

where, in the formulas (2) to (4), $R^{11}$ and $R^{12}$ are bound to each other to form a substituted or unsubstituted morpholino group or a substituted or unsubstituted 1-piperidyl group, $R^{13}$ and $R^{14}$ are bound to each other to form a substituted or unsubstituted morpholino group or a substituted or unsubstituted 1-piperidyl group, $R^{15}$ and $R^{16}$ are bound to each other to form a substituted or unsubstituted morpholino group or a substituted or unsubstituted 1-piperidyl group, $R^{17}$ and $R^{18}$ are bound to each other to form a substituted or unsubstituted morpholino group or a substituted or unsubstituted 1-piperidyl group, and $R^{19}$ and $R^{20}$ are bound to each other to form a substituted or unsubstituted morpholino group or a substituted or unsubstituted 1-piperidyl group.

3. The electrophotographic photosensitive member according to claim 1, wherein the content of the amine compound represented by the formula (1) in the undercoat layer is 0.05% by mass or more and 15% by mass or less.

4. The electrophotographic photosensitive member according to claim 1, wherein the charge generating material is hydroxygallium phthalocyanine.

5. The electrophotographic photosensitive member according to claim 1, wherein the photosensitive layer has a charge generation layer comprising the charge generating material and a hole transport layer formed on the charge generation layer and comprising the hole transporting material.

6. The electrophotographic photosensitive member according to claim 5, wherein the charge generation layer comprises the charge generating material and an amine compound represented by the formula (1).

7. The electrophotographic photosensitive member according to claim 6, wherein the amine compound represented by the formula (1) comprised in the undercoat layer has the same structure as the amine compound represented by the formula (1) comprised in the charge generation layer.

8. A process cartridge that integrally supports the electrophotographic photosensitive member according to claim 1, and at least one unit selected from the group consisting of a charging unit, a developing unit, a transfer unit and a cleaning unit, and that is detachably mountable to a main body of an electrophotographic apparatus.

9. An electrophotographic apparatus having the electrophotographic photosensitive member according to claim 1, and a charging unit, an image exposure unit, a developing unit and a transfer unit.

* * * * *